US009010165B2

(12) United States Patent
Griggs et al.

(10) Patent No.: US 9,010,165 B2
(45) Date of Patent: Apr. 21, 2015

(54) THREADED REBAR MANUFACTURING PROCESS AND SYSTEM

(75) Inventors: Francis W. Griggs, Indian Springs, AL (US); James R. Dollar, Orange Beach, AL (US); Brent Michael Morris, McCalla, AL (US); Jerry Thomas Brown, Gardendale, AL (US)

(73) Assignee: Nucor Corporation, Charlotte, NC (US)

( * ) Notice: Subject to any disclaimer, the term of this patent is extended or adjusted under 35 U.S.C. 154(b) by 984 days.

(21) Appl. No.: 13/008,751

(22) Filed: Jan. 18, 2011

(65) Prior Publication Data

US 2012/0180543 A1 Jul. 19, 2012

(51) Int. Cl.

| | |
|---|---|
| ***B21B 13/08*** | (2006.01) |
| ***E04C 5/03*** | (2006.01) |
| ***B21H 3/02*** | (2006.01) |
| ***B21B 1/16*** | (2006.01) |

(52) U.S. Cl.

CPC .. *E04C 5/03* (2013.01); *B21H 3/02* (2013.01); *B21B 1/163* (2013.01)

(58) Field of Classification Search

CPC .... B21B 1/163; B21B 27/005; B21B 27/024; B21B 2015/0014; B21H 3/02; E04C 5/03

USPC ..... 72/77, 95, 98, 187, 197, 203, 224, 226, 72/234, 71, 204, 206, 248, 250

See application file for complete search history.

(56) References Cited

U.S. PATENT DOCUMENTS

| | | | | | |
|---|---|---|---|---|---|
| 1,977,285 | A | * | 10/1934 | McClcery | 72/204 |
| 2,377,980 | A | * | 6/1945 | Surerus | 52/853 |
| 2,821,727 | A | * | 2/1958 | Corckran | 470/130 |
| 3,214,877 | A | * | 11/1965 | Akin | 428/574 |

(Continued)

FOREIGN PATENT DOCUMENTS

| | | |
|---|---|---|
| CH | 291 440 | 6/1953 |
| CN | 2547875 Y | 4/2004 |

(Continued)

OTHER PUBLICATIONS

PCT International Search Report for International Application No. PCT/US2011/061244 dated Mar. 22, 2012.

(Continued)

*Primary Examiner* — Edward Tolan

(74) *Attorney, Agent, or Firm* — Moore & Van Allen, PLLC; Jeffrey R. Gray

(57) ABSTRACT

Embodiments of the invention comprise forming a billet from molten steel and hot rolling the billet to reduce the cross sectional area of the billet. Thereafter, the billet is hot rolled into a lead pass bar having a cross-sectional area comprising a reduced width dimension located adjacent to the center longitudinal axis of the bar. In one embodiment of the invention, the billet can be formed into a lead pass bar having a cross-sectional area in the shape of an hourglass or peanut by feeding the billet through a first set of rolls. After the lead pass bar is formed, it is passed through a second set of rolls in order to form the substantially continuous threaded rebar without longitudinal ribs. The cross-sectional area of the lead pass bar helps to produce a substantially continuous threaded rebar product without longitudinal ribs using standard rebar manufacturing tooling and equipment.

69 Claims, 18 Drawing Sheets

(56) References Cited

U.S. PATENT DOCUMENTS

| | | | | |
|---|---|---|---|---|
| 3,222,873 | A | 12/1965 | Williams et al. | |
| 3,256,727 | A * | 6/1966 | Takaish | 72/234 |
| 3,494,164 | A | 2/1970 | Rehm et al. | |
| 3,561,185 | A | 2/1971 | Finsterwalder et al. | |
| 3,928,998 | A | 12/1975 | Torres | |
| 4,023,784 | A * | 5/1977 | Wallace | 266/216 |
| 4,033,502 | A | 7/1977 | Rothchild | |
| 4,056,911 | A | 11/1977 | Tani | |
| 4,076,163 | A | 2/1978 | Grande | |
| 4,087,898 | A | 5/1978 | Linne | |
| 4,092,814 | A | 6/1978 | Kern | |
| 4,114,344 | A | 9/1978 | Heasman | |
| 4,143,986 | A | 3/1979 | Antosh | |
| 4,159,633 | A | 7/1979 | Linne | |
| 4,193,283 | A * | 3/1980 | Bowman et al. | 72/204 |
| 4,193,686 | A | 3/1980 | Klank | |
| 4,229,501 | A | 10/1980 | Kern | |
| 4,241,490 | A | 12/1980 | Edwards | |
| 4,295,761 | A | 10/1981 | Hansen | |
| 4,307,979 | A | 12/1981 | Killmeyer | |
| 4,313,697 | A | 2/1982 | Rozanc | |
| 4,357,819 | A * | 11/1982 | Elley | 72/204 |
| 4,386,877 | A | 6/1983 | McDowell, Jr. | |
| 4,402,633 | A | 9/1983 | Self | |
| 4,472,088 | A | 9/1984 | Martin | |
| 4,477,209 | A | 10/1984 | Hipkins, Jr. et al. | |
| 4,501,515 | A | 2/1985 | Scott | |
| 4,516,886 | A | 5/1985 | Wright | |
| 4,518,292 | A | 5/1985 | Calandra, Jr. | |
| 4,531,861 | A | 7/1985 | Kash | |
| 4,564,315 | A | 1/1986 | Rozanc | |
| 4,584,247 | A | 4/1986 | Mulholland | |
| 4,595,315 | A | 6/1986 | Gallagher, Jr. | |
| 4,605,449 | A | 8/1986 | Schummer et al. | |
| 4,607,984 | A | 8/1986 | Cassidy | |
| 4,618,291 | A | 10/1986 | Wright | |
| 4,619,096 | A | 10/1986 | Lancelot, III | |
| 4,627,212 | A | 12/1986 | Yee | |
| 4,630,971 | A | 12/1986 | Herbst et al. | |
| 4,649,729 | A | 3/1987 | McDowell et al. | |
| 4,655,645 | A | 4/1987 | Hipkins, Sr. et al. | |
| 4,659,258 | A | 4/1987 | Scott | |
| 4,664,555 | A | 5/1987 | Herbst | |
| 4,664,561 | A | 5/1987 | Frease | |
| 4,666,326 | A | 5/1987 | Hope | |
| 4,678,374 | A | 7/1987 | Calandra, Jr. | |
| 4,679,966 | A | 7/1987 | Yacisin | |
| 4,708,559 | A | 11/1987 | Locotos | |
| 4,750,887 | A | 6/1988 | Simmons | |
| 4,752,159 | A | 6/1988 | Howlett | |
| 4,764,055 | A | 8/1988 | Clark et al. | |
| 4,779,439 | A * | 10/1988 | Baldi | 72/204 |
| 4,811,541 | A | 3/1989 | Finsterwalder | |
| 4,858,457 | A | 8/1989 | Potucek | |
| 4,861,197 | A | 8/1989 | Calandra, Jr. | |
| 4,870,848 | A | 10/1989 | Kies et al. | |
| 4,922,681 | A | 5/1990 | Russwurm et al. | |
| 4,946,314 | A | 8/1990 | Gruber | |
| 4,953,379 | A | 9/1990 | Richartz | |
| 4,955,758 | A | 9/1990 | Hyde | |
| 5,013,192 | A | 5/1991 | Scott | |
| 5,044,832 | A | 9/1991 | Gruber | |
| 5,046,878 | A | 9/1991 | Young | |
| 5,067,844 | A | 11/1991 | Bowmer et al. | |
| 5,073,065 | A | 12/1991 | Kleineke | |
| 5,094,577 | A | 3/1992 | Clark et al. | |
| 5,114,278 | A | 5/1992 | Locotos et al. | |
| 5,127,769 | A | 7/1992 | Tadolini et al. | |
| 5,152,118 | A | 10/1992 | Lancelot | |
| 5,158,527 | A | 10/1992 | Bernard | |
| 5,222,835 | A | 6/1993 | Wright | |
| 5,234,291 | A | 8/1993 | Swemmer | |
| 5,282,698 | A | 2/1994 | Wright et al. | |
| 5,352,065 | A | 10/1994 | Arnall et al. | |
| 5,375,946 | A | 12/1994 | Locotos | |
| 5,383,740 | A | 1/1995 | Lancelot, III | |
| 5,387,060 | A | 2/1995 | Locotos | |
| 5,411,347 | A | 5/1995 | Bowmer et al. | |
| 5,433,558 | A | 7/1995 | Gray | |
| 5,443,331 | A | 8/1995 | Seegmiller | |
| 5,468,524 | A | 11/1995 | Albrigo et al. | |
| 5,490,365 | A | 2/1996 | Roth | |
| 5,544,980 | A | 8/1996 | Seegmiller | |
| 5,556,234 | A | 9/1996 | Oldsen et al. | |
| 5,570,976 | A | 11/1996 | Fuller et al. | |
| 5,611,190 | A | 3/1997 | Van Merksteijn | |
| 5,626,044 | A | 5/1997 | Lara-Castro | |
| 5,664,902 | A | 9/1997 | Holdsworth | |
| 5,669,196 | A | 9/1997 | Dahl | |
| 5,735,653 | A | 4/1998 | Schiefer et al. | |
| 5,743,978 | A | 4/1998 | Otto et al. | |
| 5,763,042 | A | 6/1998 | Kaiser et al. | |
| 5,775,850 | A | 7/1998 | Gale et al. | |
| 5,791,823 | A | 8/1998 | Blakley et al. | |
| 5,791,824 | A | 8/1998 | Radtke | |
| 5,851,468 | A | 12/1998 | Kaiser | |
| 5,876,553 | A | 3/1999 | Kaiser | |
| 5,882,148 | A | 3/1999 | Mraz | |
| 6,039,509 | A | 3/2000 | Locotos | |
| 6,298,705 | B1 | 10/2001 | Shore | |
| 6,390,735 | B1 | 5/2002 | Gaudreau et al. | |
| 6,428,243 | B1 | 8/2002 | Hutchins | |
| 6,474,910 | B2 | 11/2002 | Lay | |
| 6,484,471 | B2 | 11/2002 | Steed et al. | |
| 6,491,478 | B2 | 12/2002 | Sager et al. | |
| 6,568,056 | B2 * | 5/2003 | Sclippa | 29/33 C |
| 6,698,980 | B2 | 3/2004 | Mongrain | |
| 6,886,384 | B2 | 5/2005 | Gray | |
| 6,994,496 | B2 | 2/2006 | Mills | |
| 7,044,688 | B2 | 5/2006 | Dever et al. | |
| 7,147,404 | B2 | 12/2006 | Spearing et al. | |
| 7,296,950 | B1 | 11/2007 | Stankus et al. | |
| 7,338,234 | B2 | 3/2008 | Rataj et al. | |
| 7,481,603 | B1 | 1/2009 | Fox | |
| 7,566,189 | B2 | 7/2009 | Simmons et al. | |
| 7,624,556 | B2 | 12/2009 | Plooksawasdi | |
| 7,736,738 | B2 | 6/2010 | Simmons et al. | |
| 7,775,745 | B2 | 8/2010 | Simmons et al. | |
| 2004/0161305 | A1 | 8/2004 | Simmons et al. | |
| 2004/0161316 | A1 | 8/2004 | Locotos et al. | |
| 2007/0036617 | A1 | 2/2007 | Oldsen et al. | |
| 2007/0269274 | A1 | 11/2007 | Seedsman | |
| 2008/0219775 | A1 | 9/2008 | Mercier-Langevin et al. | |
| 2009/0052995 | A1 | 2/2009 | Eriksson et al. | |
| 2009/0074516 | A1 | 3/2009 | Craig | |
| 2009/0136302 | A1 | 5/2009 | Fox | |
| 2010/0003088 | A1 | 1/2010 | Grocholewski et al. | |
| 2010/0015461 | A1 | 1/2010 | Larsen et al. | |
| 2010/0074696 | A1 | 3/2010 | Williams | |
| 2010/0252953 | A1 | 10/2010 | Simmons et al. | |

FOREIGN PATENT DOCUMENTS

| | | | | |
|---|---|---|---|---|
| DE | 31 08 268 | A1 | 9/1982 | |
| DE | 100 08 693 | A1 | 9/2001 | |
| JP | 54-124861 | A | 9/1979 | |
| JP | 63-286233 | A * | 11/1998 | B21H 8/00 |
| WO | WO 03/102374 | A1 | 12/2003 | |
| WO | WO-2005/021182 | A1 | 3/2005 | |

OTHER PUBLICATIONS

Necheporenko V. A. et al., "Pressure Treatment of Metals—Production of Reinforcing-Bar Steel By Two-Strand Rolling and Separating"; Steel in Translation, Allerton Press, New York, NY; vol. 29, No. 6, pp. 32-34, Jan. 1, 1999 (Jan. 1, 1999), XP000976468, ISSN: 0967-0912.

Second Written Opinion of the International Preliminary Examination Authority for International Application No. PCT/US2011/061244 Mailed Jan. 17, 2013.

* cited by examiner

THREADED REBAR MANUFACTURING PROCESS AND SYSTEM

FIELD

This invention relates generally to the field of threaded rebar, and more particularly embodiments of the invention relate to methods and systems of manufacturing threaded rebar using standard rebar tooling and equipment.

BACKGROUND

Reinforcing metal bars (hereinafter "rebar") are bars, often made of steel, having protruding ribs, which are typically used to reinforce concrete structures. The protruding ribs can take a number of shapes or geometries, including diamond shaped, X-shaped, V-shaped, etc. During the construction of bridges, buildings, and similar structures the rebar is often placed in a concrete form and concrete is poured around the rebar. The ribs in the rebar help to anchor the rebar within the concrete. The rebar adds strength to the structures in which it is used.

In typical rebar manufacturing heated bar stock is fed through rolls to form the cylindrical shaped rebar and protruding ribs. In some applications the ribs on the rebar can be manufactured to form threads that extend around the periphery of the core of the rebar. In such threaded rebar, the external threads are able to receive a nut, collar, coupling, or other apparatus, which has internal threads that engage the external threads on the threaded rebar. Threaded rebar can be used to attach the ends of successive rebar pieces together using a coupling that mates with the threads on the ends of successive pieces of rebar and transfers loads within casted concrete structures, precast concrete structural members, etc. Threaded rebar can also be used to secure metal structures to concrete and rebar foundations (i.e., lampposts, bridges, etc.). Furthermore, threaded rebar can be used as bolts, for example in such applications as rock bolts in mining operations.

Standard rebar and threaded rebar can be manufactured by cold rolling or hot rolling metal billets. In both processes a billet is fed between two cylindrical rolls that form the billet into the rebar. The cylindrical rolls have grooves with notches (i.e. knurls) formed therein to receive a bar and form the core rebar shape and protruding ribs as the bar passes through the rolls. In some rebar manufacturing processes flat dies can replace the cylindrical rolls. The flat dies also have grooves with notches formed therein, and are spaced apart to receive a bar that is rotated between them in order to create threads or ribs along the length of the rebar or a portion thereof.

When threaded rebar is manufactured using cold rolling, the bar is passed through the rolls below the recrystallization temperature of the metal, which increases the strength of the metal, improves the surface finish, and results in tighter tolerances on the rebar core and threaded ribs. However, cold rolling also causes work hardening of the metal, which results in the metal becoming brittle, and thus, more susceptible to cracking at the base of the formed threaded ribs. These problems are particularly acute where threaded rebar is used with a nut or a collar, and in these applications the cold rolled threaded rebar is susceptible to premature thread failure.

In a hot rolling process the bar is passed through the rolls above the recrystallization temperature of the metal, which prevents work hardening that can lead to thread failures. Threaded rebar made from hot rolling results in threaded rebar having uniform tensile strength and elongation characteristics, as well as ribs that are less likely to crack because they are an integral part of the bar and not work hardened.

Furthermore, hot rolling allows for the use of steels with higher tensile strength, and hot rolling processes do not require additional bar peeling or swaging of the threaded rebar. The problems with threaded rebar manufactured through hot rolling include the formation of ribs that are coarse and unable to be used in applications requiring tight thread tolerances.

Threaded rebar can also be manufactured by forming standard rebar (utilizing either cold rolling or hot rolling), and thereafter, machining a portion of the rebar to add the desired threads. Machined threads result in tight tolerances; however, machined threads are weaker than cold rolled threads. Moreover, manufacturing threaded rebar by machining the threads significantly increases the manufacturing costs associated with the threaded rebar, as it requires multiple processing steps, as well as time consuming and expensive handling.

There are a number of problems associated with manufacturing threaded rebar using cylindrical rolls in a hot rolling process. Cylindrical rolls are used to form square, cylindrical, or other shaped bars into circular rebar with transverse threads formed into opposite sides of the circular rebar. The transverse threads formed are discontinuous and in some cases not aligned if the cylindrical rolls are not properly synchronized. Moreover, in these processes, two longitudinal ribs are formed along the length of the threaded rebar, which is a result of the excess metal from inconsistencies in the shape of the bar as well as the gap between the cylindrical rolls used to form the threaded rebar. The gap between the rolls is necessary so that the rolls do not rub against each other during the rolling process, since such rubbing may result in frictional heat that could damage the rolling system. The longitudinal ribs that result from processing prevent the threaded rebar from being freely rotatable within a nut or other mating internally threaded coupling. In order to manufacture threaded rebar without longitudinal ribs, additional steps are necessary that machine or shear off the longitudinal ribs. In some processes only the longitudinal ribs are machined off, however, in other processes the entire face of the bar with the longitudinal rib is machined into a flat surface. In still other processes the longitudinal ribs are sheared off using saw-tooth rotary dies, which are spaced apart to shear off sections of the longitudinal ribs located between the transverse ribs on the threaded rebar. In other processes the longitudinal ribs are ground off using a smooth groove rotary die that grinds down the longitudinal ribs. All of these methods present significant drawbacks, including additional processing steps, additional processing time, and additional processing equipment, all of which increase the cost of manufacturing the threaded rebar.

Continuous threaded rebar is more desirable than discontinuous threaded rebar since it increases the tensile strength of the rebar due to the increased surface area contact with the mating nut, threaded bore hole, etc. In some embodiments of the invention, a continuous or significantly continuous transverse rib can be produced through hot or cold rolling processes. However, in order to produce a continuous or significantly continuous spiral transverse rib more than two opposing dies are used (i.e. three or four opposing dies that form the threaded rebar at the same time), whereas in standard rebar manufacturing only two dies are used. The need for more than two dies results in increased equipment costs and increased die set-up costs when changing the tooling between standard rebar manufacturing equipment and continuous or significantly continuous threaded rebar manufacturing equipment. A continuous transverse rib can also be produced on bar stock using processes other than rolling, but these processes are also more time consuming and costly because of the additional equipment costs and tooling set-up times.

Therefore, there is a need to develop methods and systems that can be used to produce threaded rebar at reduced costs and in shorter manufacturing times.

BRIEF SUMMARY

Embodiments of the present invention address the above needs and/or achieve other advantages by providing systems and methods that are used to create threaded rebar with substantially continuous threads using a rolling process, wherein a majority of the circumference of the threaded rebar is covered by the discontinuous threads; and wherein no additional steps are required to remove longitudinal ribs in the threaded rebar.

Embodiments of the invention comprise forming a billet from molten steel and hot rolling the billet to reduce the cross-sectional area of the billet. Thereafter, the billet is hot rolled into a lead pass bar having a cross-sectional area comprising a reduced width dimension located adjacent to the center longitudinal axis of the bar. In one embodiment of the invention, the billet can be formed into a bar having a cross-sectional area in the shape of an hourglass or peanut (i.e., the hourglass lead pass bar) by feeding the billet through a first set of rolls (i.e., lead pass roll set). After the hourglass lead pass bar is formed, it is passed through a second set of rolls (i.e., threaded pass roll set) in order to form the substantially continuous threaded rebar without longitudinal ribs. As explained in further detail below the cross-sectional area of the lead pass bar helps to produce a substantially continuous threaded rebar product without longitudinal ribs using standard rebar manufacturing tooling and equipment.

Embodiments of the invention comprise methods of manufacturing threaded rebar and products made from the methods of manufacturing threaded rebar. One embodiment of the invention is a method of manufacturing threaded rebar comprising providing a lead pass bar comprising a body extending along a longitudinal axis, wherein at least one portion of the body has a cross-section defining a plane that intersects the longitudinal axis, wherein a first part of the plane has a first width and a second part of the plane has a second width and wherein the first width is not equal to the second width; and forming a threaded rebar from the lead pass bar.

In further accord with another embodiment of the invention, the plane has a height dimension substantially centered along the longitudinal axis, wherein the first part of the plane is located vertically adjacent to the longitudinal axis and the first width is smaller than the second width of the second part of the plane located vertically distal from the longitudinal axis.

In another embodiment of the invention, the first part of the plane is vertically adjacent to the longitudinal axis and the first width is smaller than the second width of the second part of the plane and a third width of a third part of the plane, wherein the second part of the plane and third part of the plane are located vertically distal from the longitudinal axis.

In yet another embodiment of the invention, the first part of the plane is rectangular in shape and the second part of the plane and third part of the plane are at least approximately circular, wherein the second part of the plane is located vertically above the first part of the plane and the third part of the plane is located vertically below the first part of the plane.

In still another embodiment of the invention, the plane is peanut shaped or the plane is hourglass shaped.

In further accord with another embodiment of the invention, the first width of the first part of the plane is less than or equal to ninety percent of the second width of the second part of the plane.

In another embodiment of the invention, providing the lead pass bar comprises forming the lead pass bar from a billet. In yet another embodiment of the invention, the lead pass bar is formed by rolling the billet though a lead pass roll set having opposed lead pass grooves that create the cross-section defining the plane that intersects the longitudinal axis comprising the first part of the plane having the first width and the second part of the plane having the second width.

In still another embodiment of the invention, the opposed lead pass grooves have a depth in the range of 0.178 and 0.2705 inches, a radius of curvature in the range of 0.1470 and 0.7442 inches, and a corner radius of curvature in the range of 0.3378 and 0.757 inches, all inclusive.

In further accord with an embodiment of the invention, the lead pass roll set has a first lead pass roll spaced apart from a second lead pass roll to create a gap between the first lead pass roll and the second lead pass roll in a range of 0.005 and 0.250 inches inclusive.

In another embodiment of the invention, the lead pass bar is formed through hot rolling at a temperature in the range of 1650 degrees to 2250 degrees Fahrenheit inclusive. In yet another embodiment of the invention, the lead pass bar is formed through rolling at a rate in the range of 300 to 2600 feet per minute inclusive.

In still another embodiment of the invention, forming the threaded rebar comprises rolling the lead pass bar though a threaded pass roll set having opposed threaded pass grooves with opposed threaded pass knurls in the opposed threaded pass grooves.

In further accord with an embodiment of the invention, the opposed threaded pass grooves have a depth in the range of 0.2015 and 0.386 inches, a groove radius of curvature in the range of 0.2358 and 0.4270 inches, and a corner radius of curvature in the range of 0.0355 and 0.0447 inches, all inclusive. In another embodiment of the invention, the opposed threaded pass knurls have a depth in the range of 0.040 and 0.0727 inches, and a knurl radius of curvature in the range of 0.2989 and 0.5002 inches, all inclusive.

In yet another embodiment of the invention, the threaded pass roll set has a first threaded pass roll spaced apart from a second threaded pass roll to create a gap between the first lead pass roll an the second lead pass roll in a range of 0.005 and 0.250 inches inclusive.

In still another embodiment of the invention, the threaded rebar is formed through hot rolling at a temperature in the range of 1650 degrees to 2250 degrees Fahrenheit inclusive. In further accord with an embodiment of the invention, the threaded rebar is formed through rolling at a rate in the range of 300 to 2600 feet per minute inclusive.

In another embodiment of the invention, forming the billet comprises melting scrap steel into molten metal in an electric arc furnace; transferring the molten metal from the electric arc furnace to a ladle for refining; transferring the molten metal from the ladle to a tundish; depositing the molten metal from the tundish into a water cooled mold to form a strand of steel; passing the strand of steel through rollers and water sprayers to solidify the strand of steel into the billet; cutting the billet into the desired lengths; heating the billet in a reheating furnace for rolling; and passing the billet through one or more rolling mill stands to reduce the cross-sectional area of the billet.

In yet another embodiment of the invention, the lead pass bar comprises the height dimension in the range of 0.8210 to 1.378 inches, a first part width dimension in the range of 0.4080 and 0.6490 inches, and a second part width dimension in the range of 0.3110 and 0.579 inches, all inclusive.

In still another embodiment of the invention, the method further comprises cutting grooves into a lead pass roll set for forming the lead pass bar. In further accord with an embodiment of the invention, the method further comprises installing a lead pass roll set. In another embodiment of the invention, the method further comprises cutting opposed threaded pass grooves into a threaded pass roll set for forming the threaded rebar, and cutting a plurality of opposed threaded pass knurls into the opposed threaded pass grooves of the threaded pass roll set for forming the threads of the threaded rebar.

In yet another embodiment of the invention, the method further comprises installing a threaded pass roll set for forming the threaded rebar. In still another embodiment of the invention, the method further comprises synchronizing a first threaded pass roll and a second threaded pass roll in a threaded pass roll set in order to substantially align top threads and bottom threads on the threaded rebar.

In further accord with an embodiment of the invention, forming the threaded rebar comprises forming the threaded rebar with substantially continuous threads. In another embodiment of the invention, a single thread of the substantially continuous threads covers ninety percent or more of the circumference of the threaded rebar.

Another embodiment of the invention comprises an apparatus for manufacturing threaded rebar. The apparatus comprises a lead pass roll set comprising a first lead pass roll and a second lead pass roll, wherein the first lead pass roll and the second lead pass roll have opposed lead pass grooves that form a lead pass bar having a body extending along a longitudinal axis, wherein at least one portion of the body has a cross-section defining a plane that intersects the longitudinal axis, wherein a first part of the plane has a first width and a second part of the plane has a second width and wherein the first width is not equal to the second width.

In further accord with an embodiment of the invention, the plane has a height dimension substantially centered along the longitudinal axis, wherein the first part of the plane is located vertically adjacent to the longitudinal axis and the first width is smaller than the second width of the second part of the plane located vertically distal from the longitudinal axis.

In another embodiment of the invention, the first part of the plane is vertically adjacent to the longitudinal axis and the first width is smaller than the second width of the second part of the plane and a third width of a third part of the plane, wherein the second part of the plane and third part of the plane are located vertically distal from the longitudinal axis.

In yet another embodiment of the invention, the first part of the plane is rectangular in shape and the second part of the plane and third part of the plane are at least approximately circular, wherein the second part of the plane is located vertically above the first part of the plane and the third part of the plane is located vertically below the first part of the plane.

In still another embodiment of the invention, the plane is peanut shaped or the plane is hourglass shaped. In further accord with an embodiment of the invention, the first width of the first part of the plane is less than or equal to ninety percent of the second width of the second part of the plane.

In another embodiment of the invention, the apparatus further comprises one or more mill stands, wherein the one or more mill stands receive a billet with a cross-sectional area and reduce the cross-sectional area of the billet, and wherein the lead pass roll set uses the billet to form the lead pass bar.

In yet another embodiment of the invention, the apparatus further comprises a threaded pass roll set, wherein the threaded pass roll set forms a threaded rebar from the lead pass bar.

In still another embodiment of the invention, the opposed lead pass grooves have a depth in the range of 0.178 and 0.2705 inches, a radius of curvature in the range of 0.1470 and 0.7442 inches, and a corner radius of curvature in the range of 0.3378 and 0.757 inches, all inclusive.

In further accord with an embodiment of the invention, the first lead pass roll is spaced apart from the second lead pass roll to create a gap between the first lead pass roll and the second lead pass roll in a range of 0.005 to 0.250 inches inclusive.

In another embodiment of the invention, the threaded pass roll set comprises a first threaded pass roll and a second threaded pass roll, wherein the first threaded pass roll and the second threaded pass roll have opposed threaded pass grooves with opposed threaded pass knurls in the opposed threaded pass grooves.

In yet another embodiment of the invention, the opposed threaded pass grooves have a depth in the range of 0.2015 and 0.386 inches, a groove radius of curvature in the range of 0.2358 and 0.4270 inches, and a corner radius of curvature in the range of 0.0355 and 0.0447 inches, all inclusive.

In still another embodiment of the invention, the opposed threaded pass knurls have a depth in the range of 0.040 and 0.0727 inches, and a knurl radius of curvature in the range of 0.2989 and 0.5002 inches, all inclusive.

In further accord with an embodiment of the invention, the first threaded pass roll is spaced apart from the second threaded pass roll to create a gap between the first threaded pass roll and the second threaded pass roll in a range of 0.005 to 0.250 inches inclusive.

In another embodiment of the invention, the apparatus further comprises an electric arc furnace, wherein the electric arc furnace melts scrap steel into molten metal; a ladle, wherein the ladle is used for refining the molten metal; a tundish, wherein the tundish holds the molten metal; a water cooled mold, wherein the water cooled mold forms a strand of steel from the molten metal received from the tundish; rollers and water sprayers, wherein the rollers and water sprayers solidify the strand of steel into a billet; a cutter, wherein the cutter cuts the billet into the desired lengths; and a reheating furnace, wherein the reheating furnace heats the billet for rolling.

In yet another embodiment of the invention, the apparatus further comprises a coupling box, wherein the coupling box synchronizes the first threaded pass roll and the second threaded pass roll in order to substantially align opposed threaded pass knurls for forming substantially aligned top threads and bottom threads on the threaded rebar.

The features, functions, and advantages that have been discussed may be achieved independently in various embodiments of the present invention or may be combined in yet other embodiments, further details of which can be seen with reference to the following description and drawings.

BRIEF DESCRIPTION OF THE SEVERAL VIEWS OF THE DRAWINGS

Figure 1:
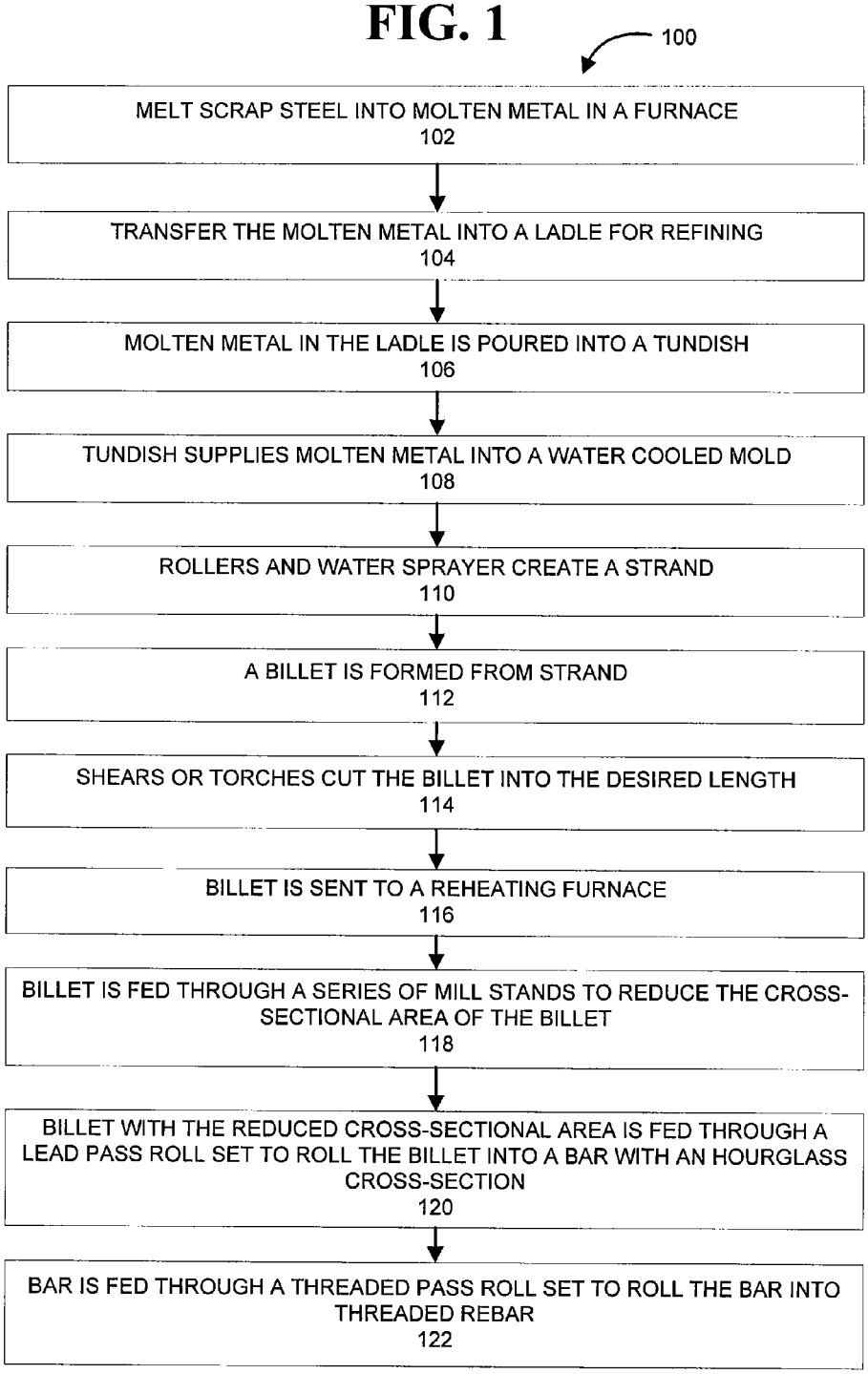
Figure 2:
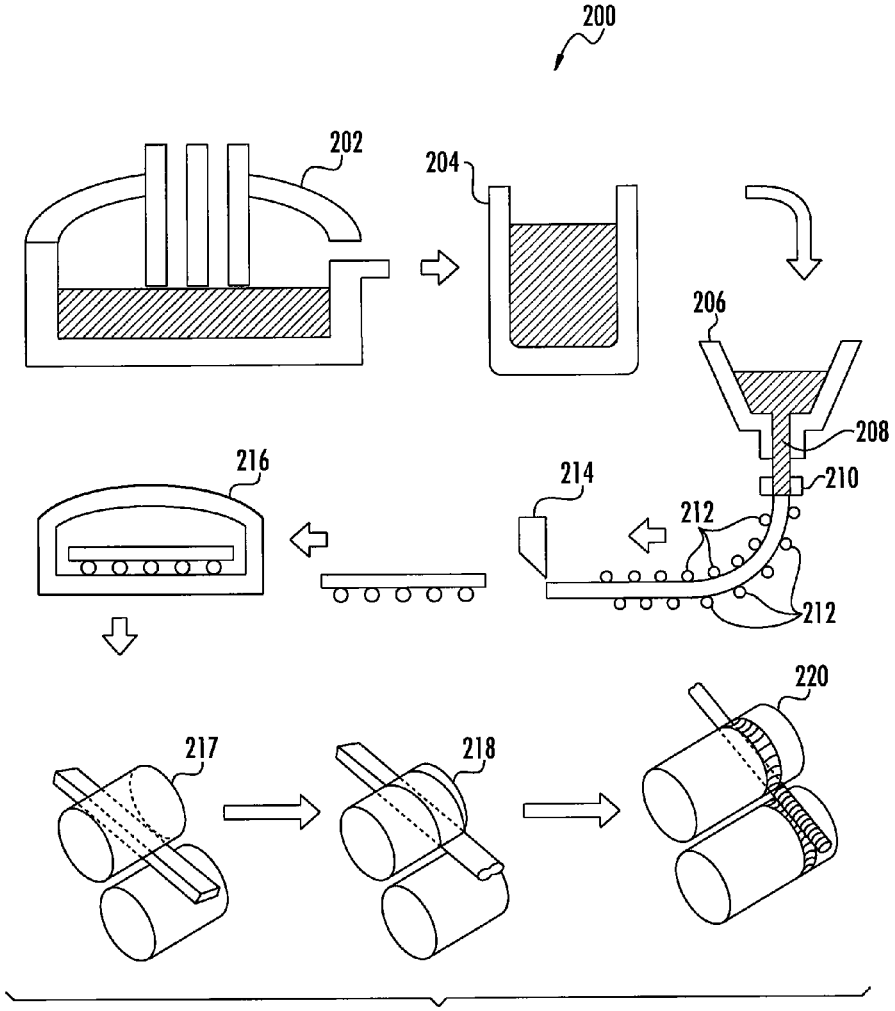
Figure 3A:
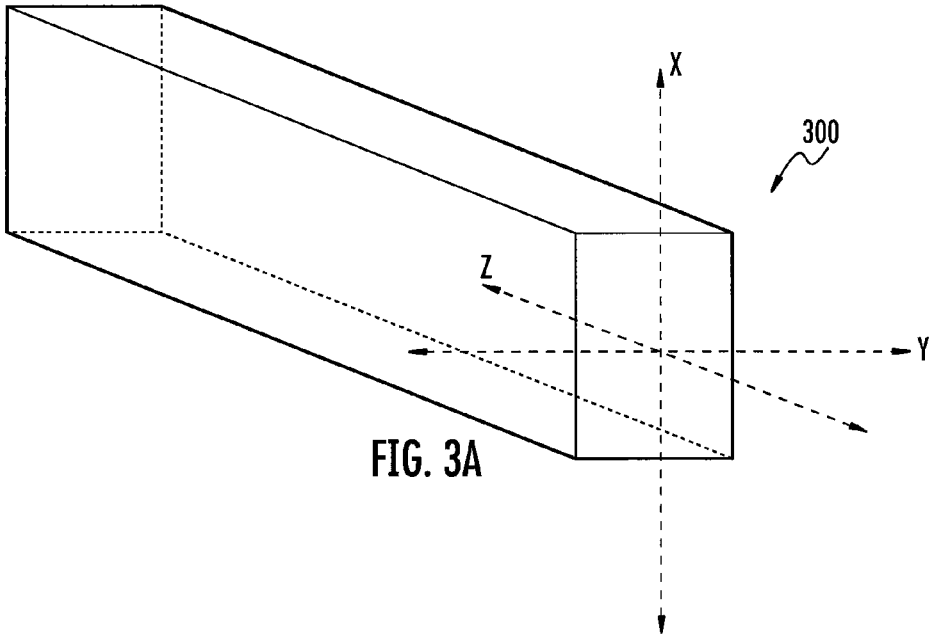
Figure 3B:
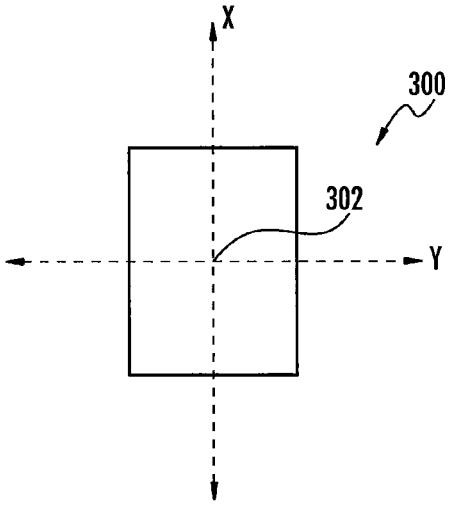
Figure 4A:
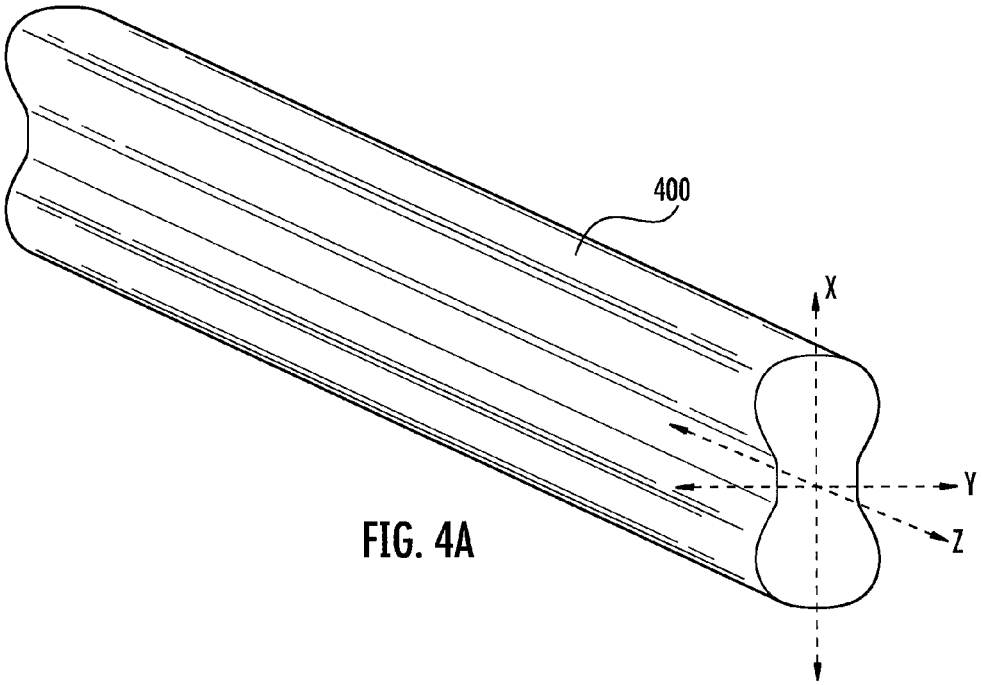
Figure 4B:
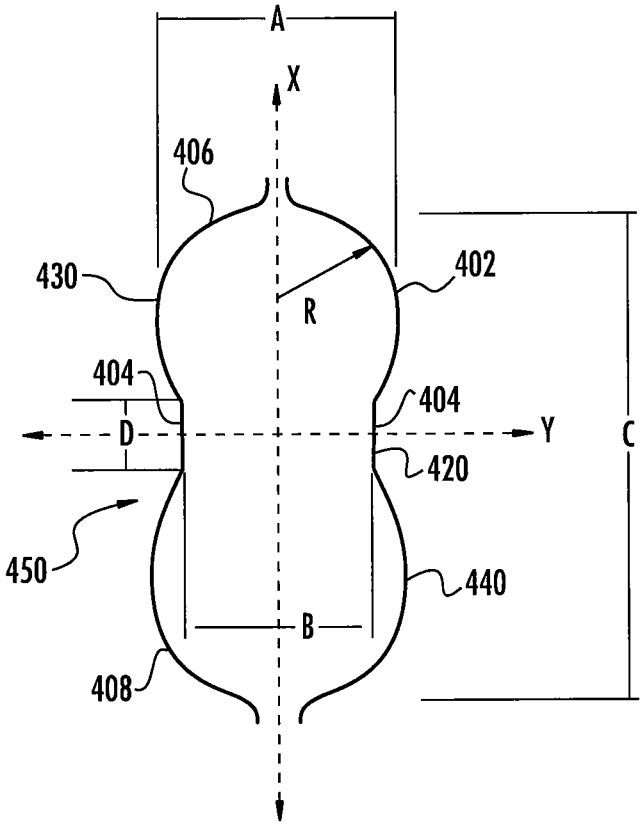
Figure 4C:
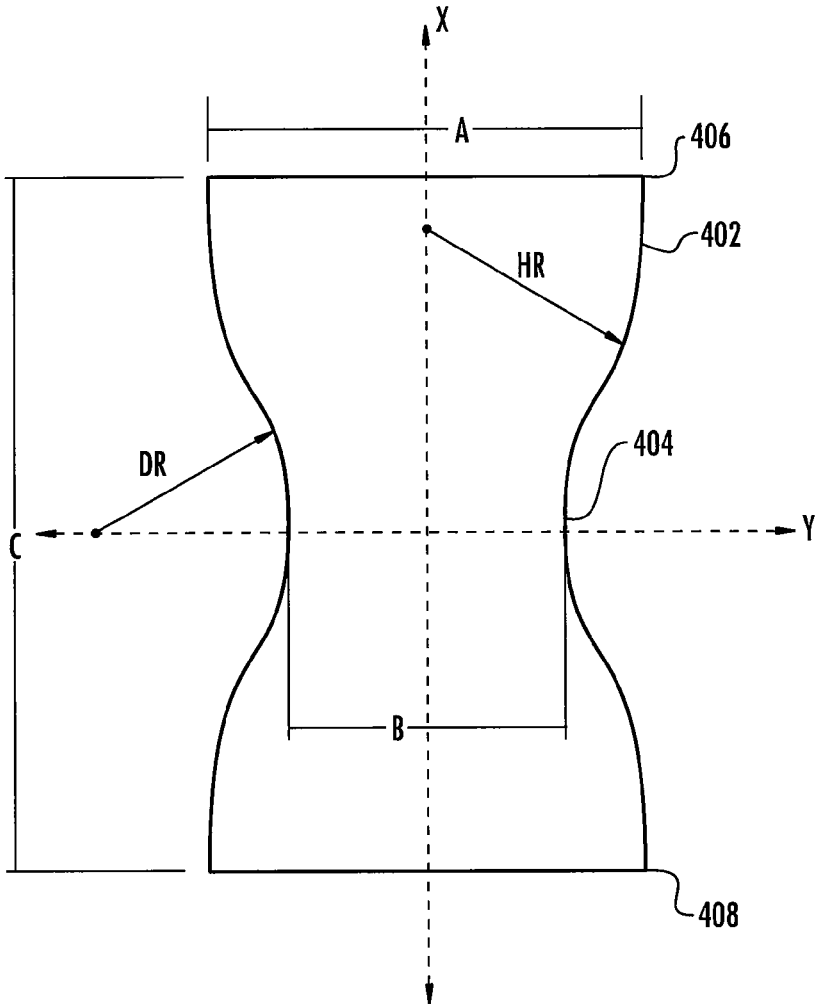
Figure 5A:
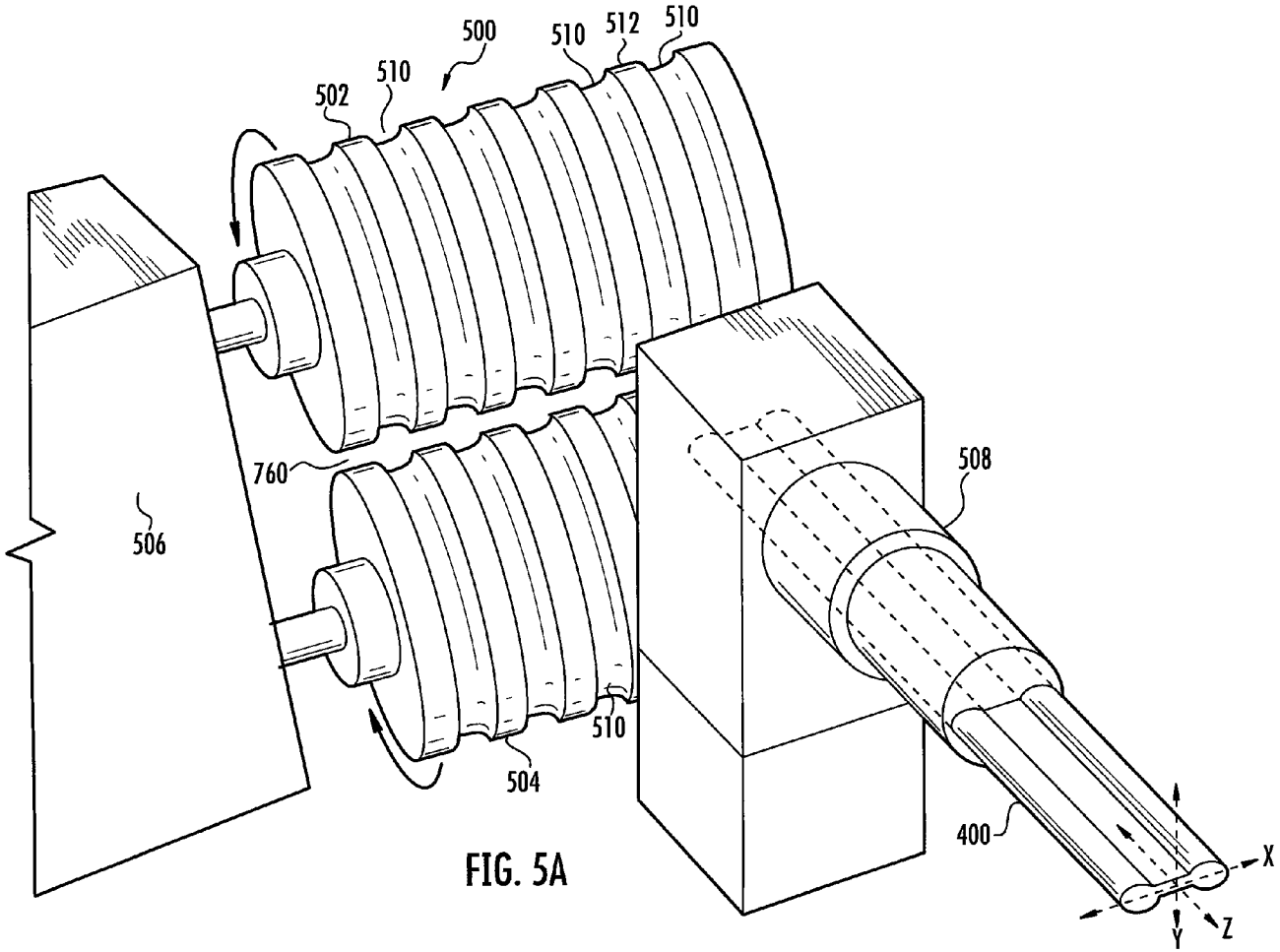
Figure 5B:
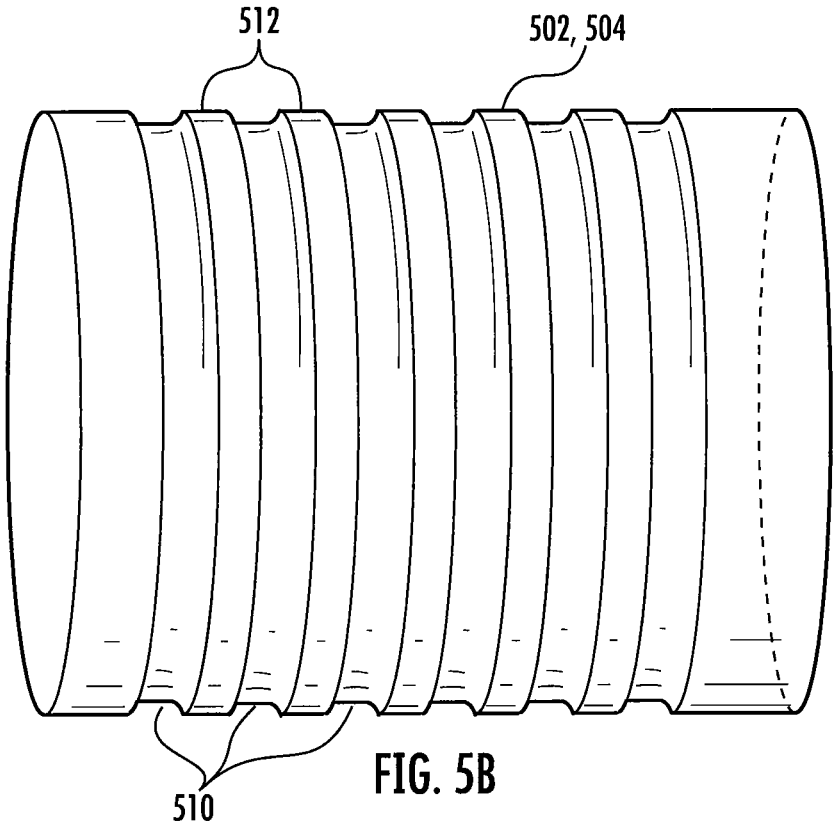
Figure 5C:
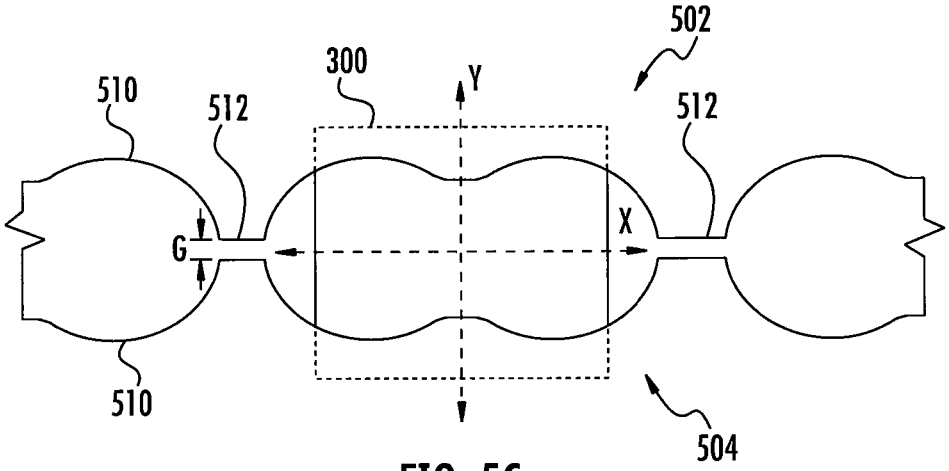
Figure 6A:
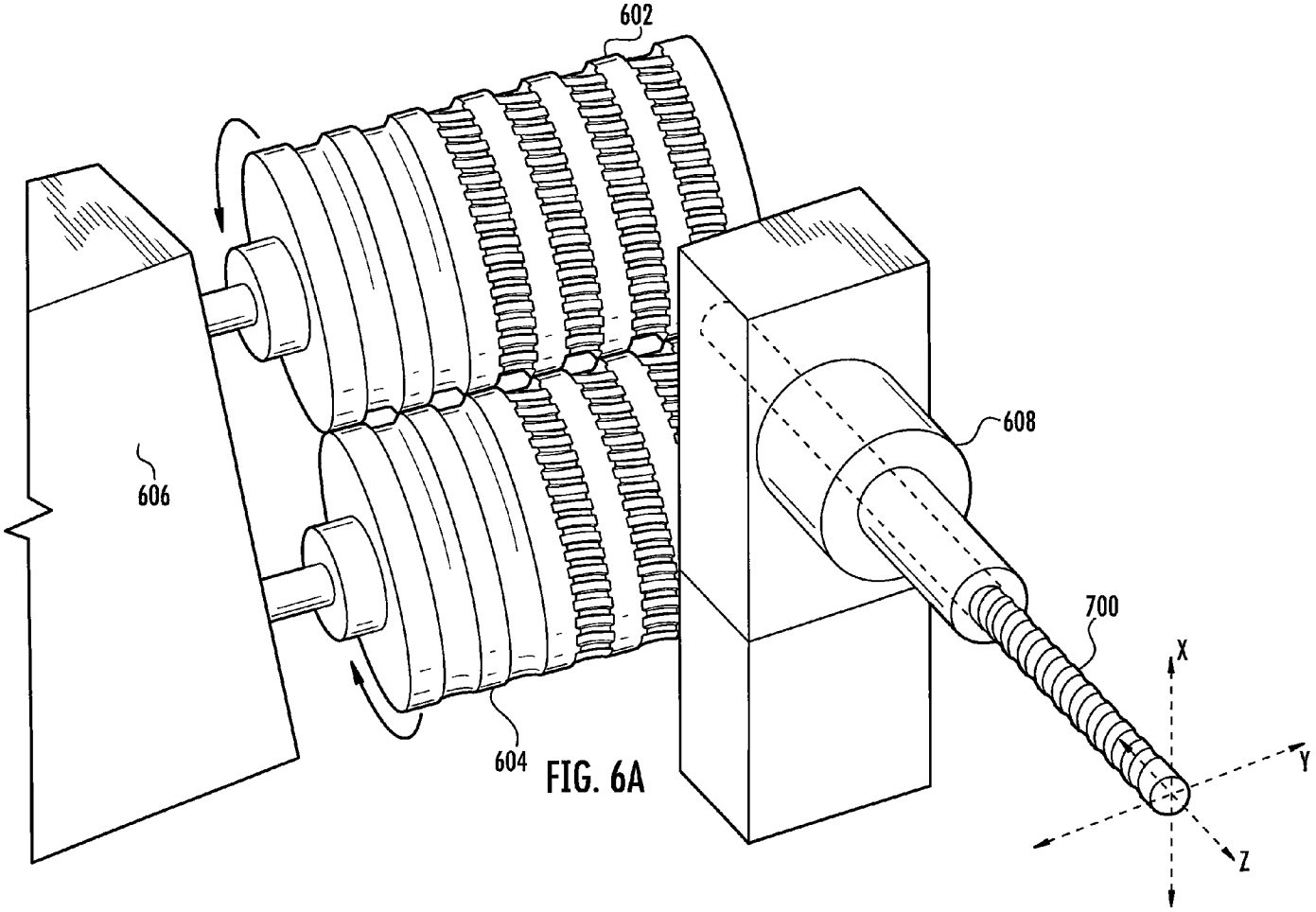
Figure 6B:
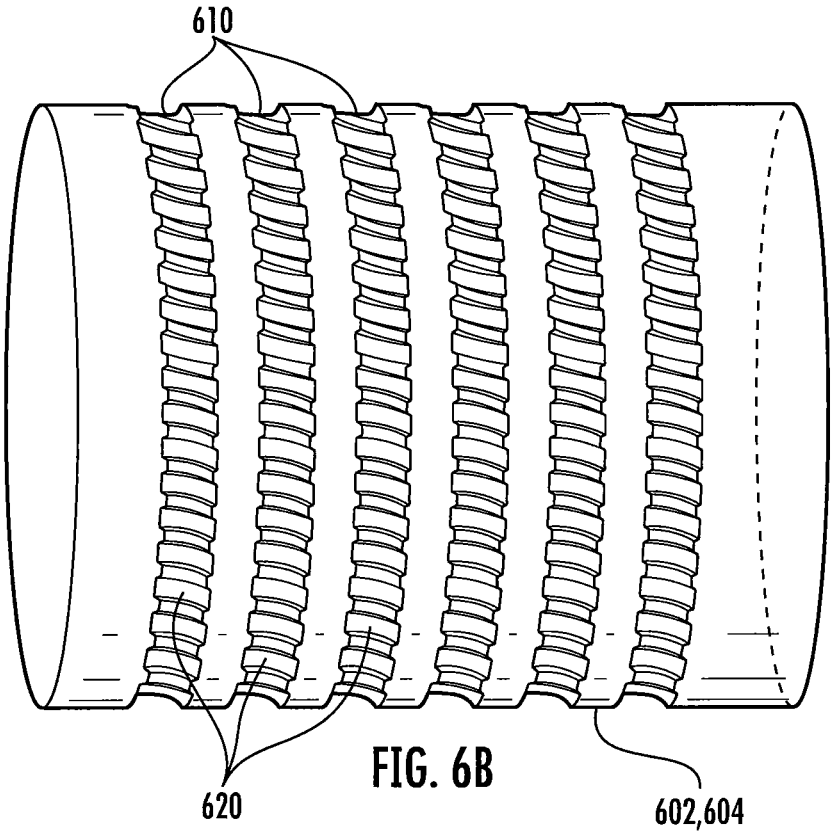
Figure 6C:
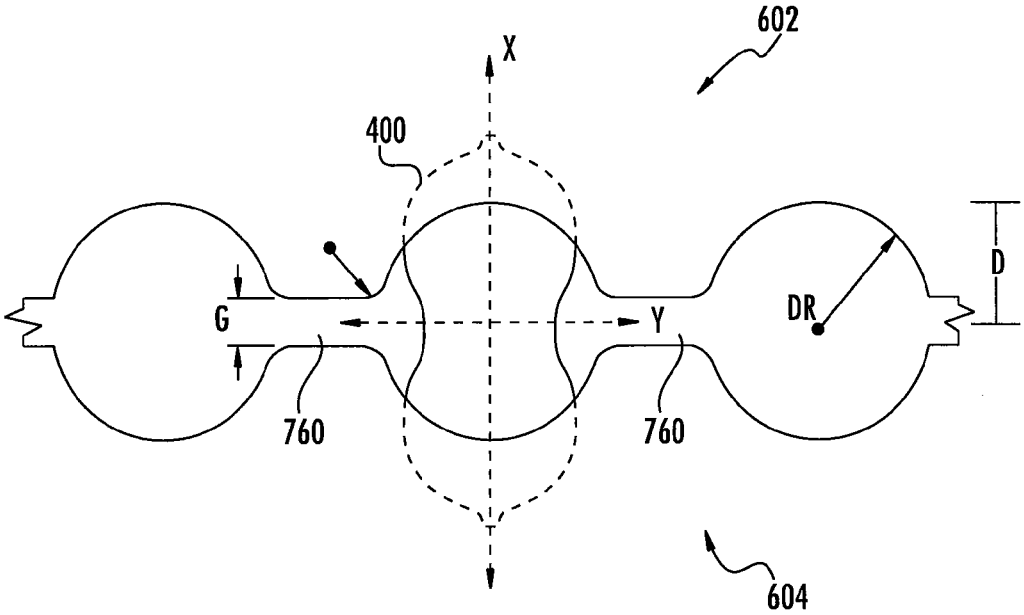
Figure 7A:
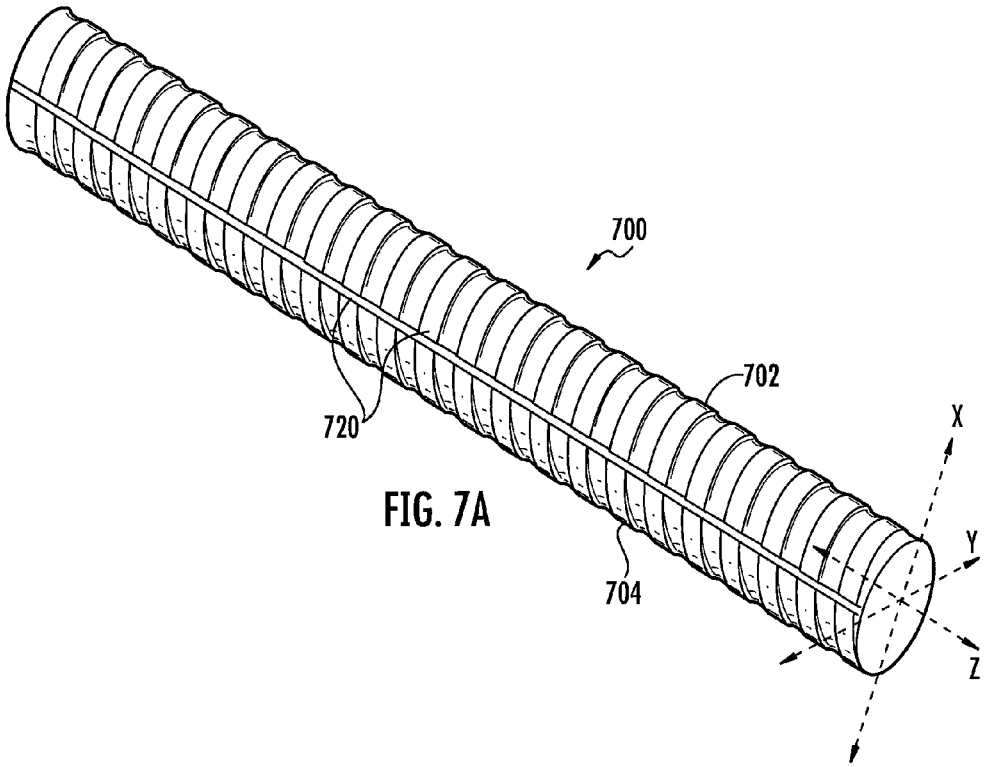
Figure 7B:
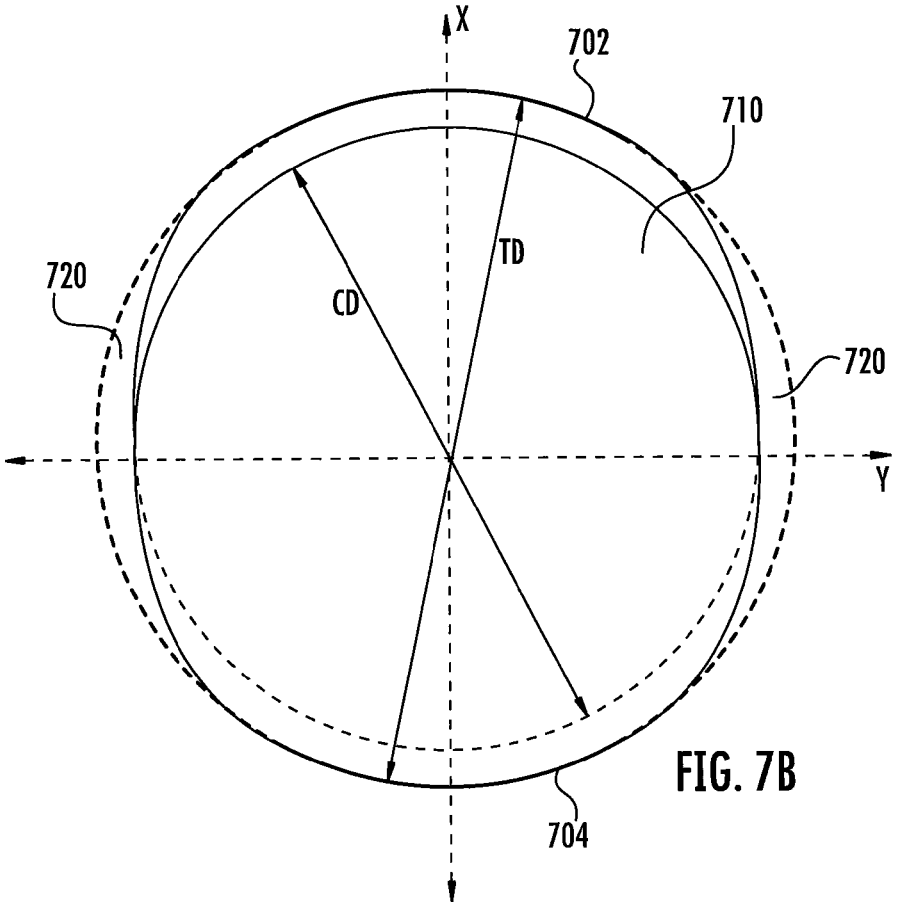
Figure 8:
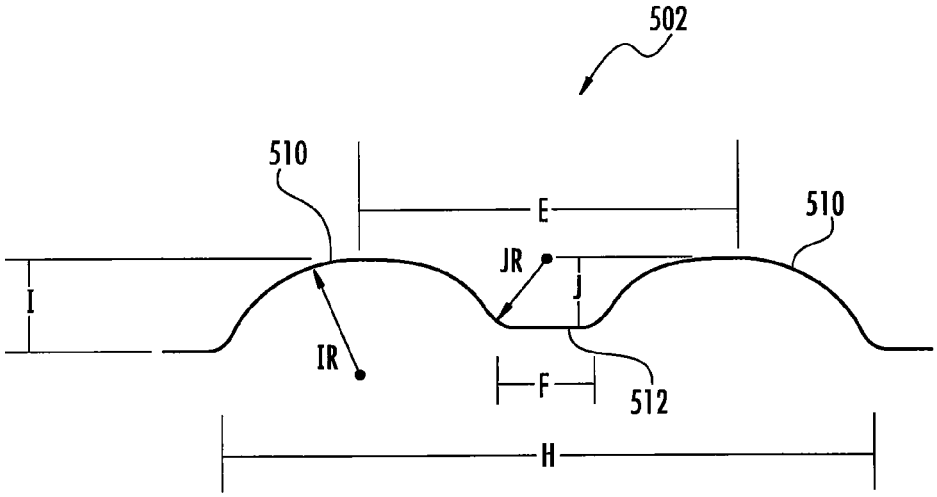
Figure 9A:
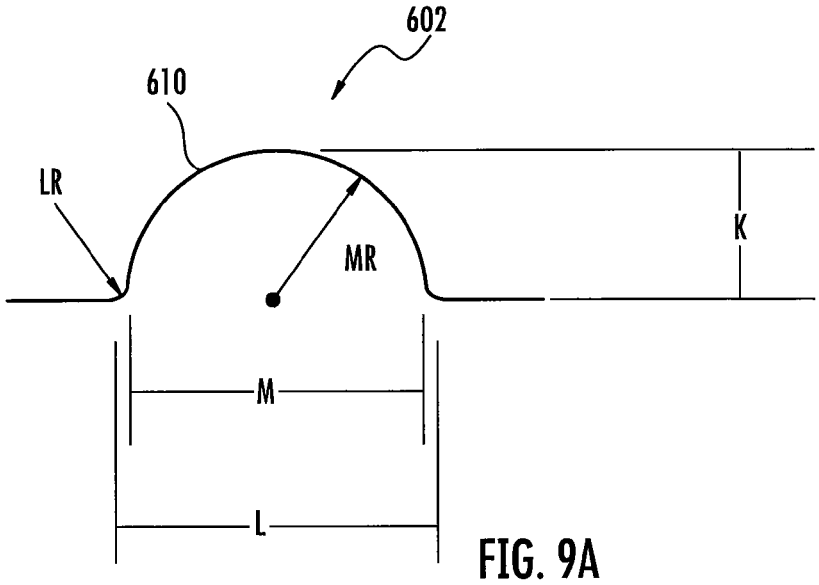
Figure 9B:
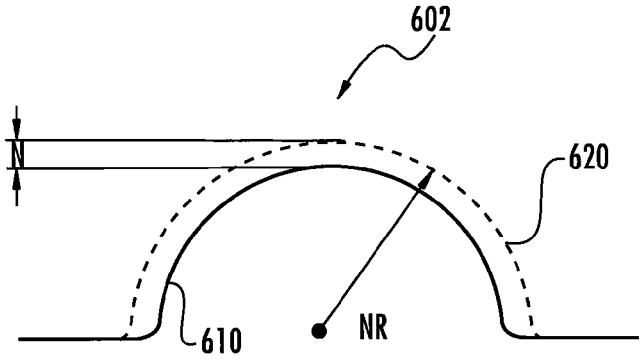
Figure 10:
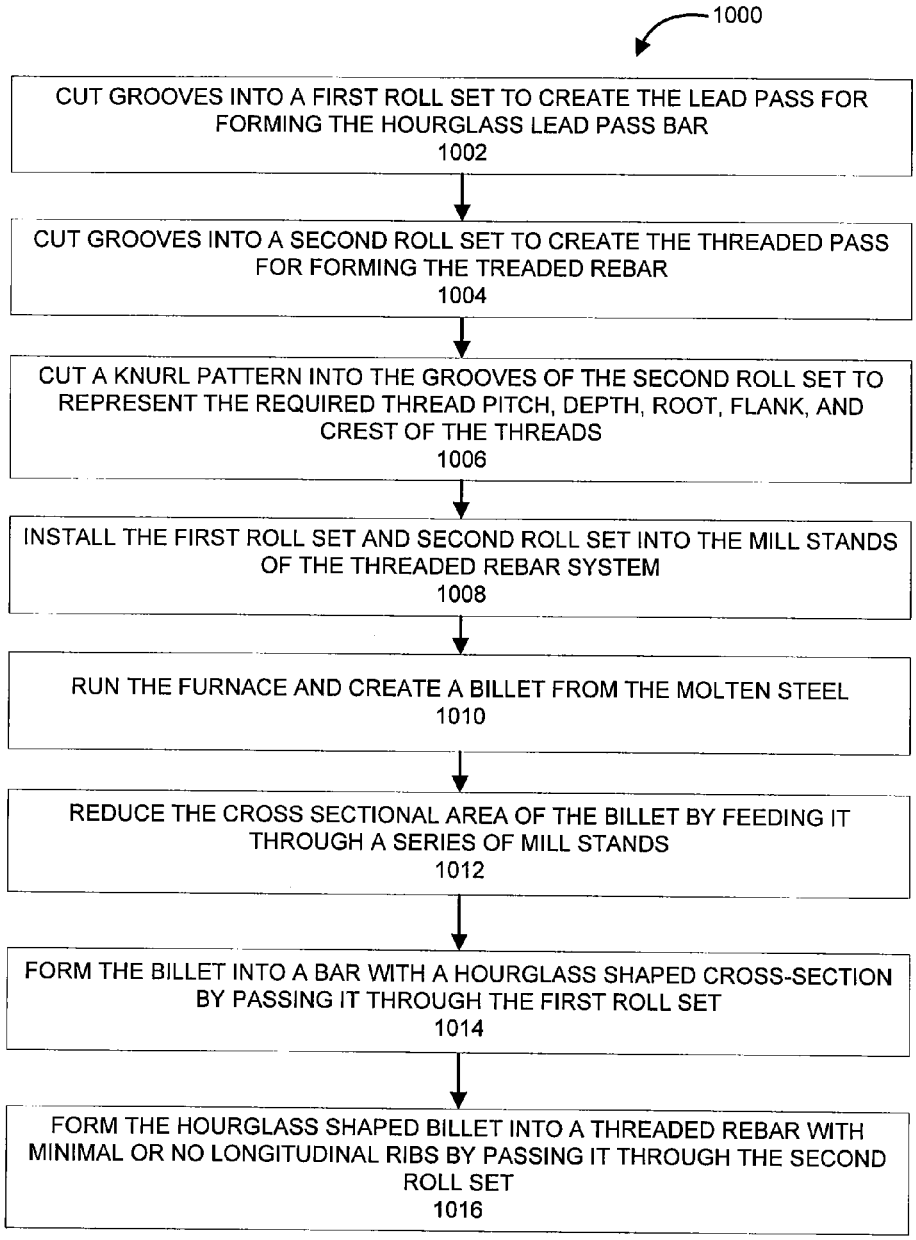
Figure 11:
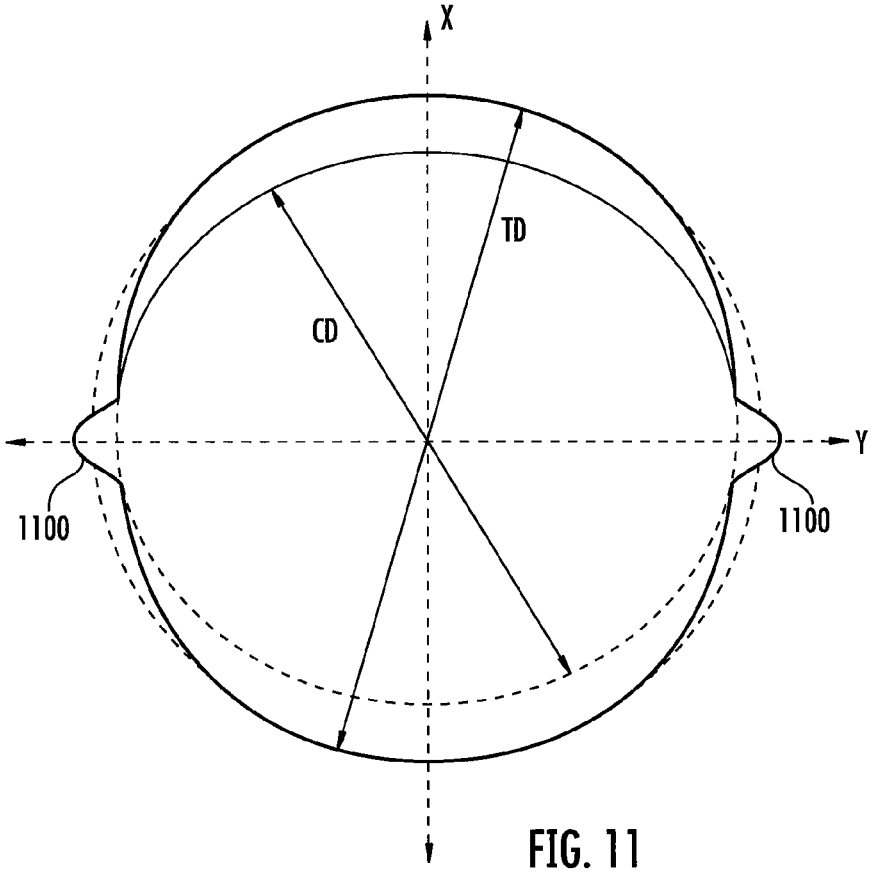
FIG. 11 (PRIOR ART)

Having thus described embodiments of the invention in general terms, reference will now be made to the accompanying drawings, wherein:

FIG. 1 provides a process flow for forming threaded rebar, in accordance with one embodiment of the present invention;

FIG. 2 provides a system diagram illustrating the system used for forming the threaded rebar, in accordance with one embodiment of the present invention;

FIG. 3A provides a perspective view of a rectangular billet used in producing threaded rebar, in accordance with one embodiment of the present invention;

FIG. 3B provides a cross-sectional front view of a rectangular billet used in producing threaded rebar, in accordance with one embodiment of the present invention;

FIG. 4A provides a perspective view of a hourglass lead pass bar used in producing threaded rebar, in accordance with one embodiment of the present invention;

FIG. 4B provides a cross-sectional view of a hourglass lead pass bar with rounded ends used in producing threaded rebar, in accordance with one embodiment of the present invention;

FIG. 4C provides a cross-sectional view of a hourglass lead pass bar with square ends used in producing threaded rebar, in accordance with one embodiment of the present invention;

FIG. 5A provides a perspective view of a lead pass roll set used to form the lead pass bar, in accordance with one embodiment of the present invention;

FIG. 5B provides a perspective view of a lead pass roll used to form the lead pass bar, in accordance with one embodiment of the present invention;

FIG. 5C provides a cross-sectional view of a first lead pass roll, a second lead pass roll, and a rectangular billet being fed between the first lead pass roll and the second lead pass roll, in accordance with one embodiment of the present invention;

FIG. 6A provides a perspective view of a threaded pass roll set used to form the threaded rebar, in accordance with one embodiment of the present invention;

FIG. 6B provides a perspective view of a threaded pass roll used to form the threaded rebar, in accordance with one embodiment of the present invention;

FIG. 6C provides a cross-sectional view of a first threaded pass roll, a second threaded pass roll, and a hourglass lead pass bar being fed between the first threaded pass roll and the second threaded pass roll, in accordance with one embodiment of the present invention;

FIG. 7A provides a perspective view of a threaded rebar without longitudinal ribs, in accordance with one embodiment of the present invention;

FIG. 7B provides a cross-sectional view of a threaded rebar without longitudinal ribs, in accordance with one embodiment of the present invention;

FIG. 8 provides a cross-sectional view of the grooves in the lead pass roll that are used in creating the hourglass lead pass bar, in accordance with one embodiment of the present invention;

FIG. 9A provides a cross-sectional view of a groove in the threaded pass roll that is used to produce the threaded rebar, in accordance with one embodiment of the present invention; and FIG. 9B provides a cross-sectional view of a groove and knurl in the threaded pass roll that are used to produce the threaded rebar, in accordance with one embodiment of the present invention;

FIG. 10 provides a process flow for setting up and using the threaded rebar system to form the threaded rebar, in accordance with one embodiment of the present invention; and FIG. 11 provides a cross-sectional view of a prior art threaded rebar with longitudinal ribs, in accordance with one embodiment of the present invention.

DETAILED DESCRIPTION OF EMBODIMENTS OF THE INVENTION

Embodiments of the present invention will now be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

FIG. 1 illustrates a threaded rebar manufacturing process 100 flow chart for forming a deformed threaded rebar 700, see FIG. 7A. Generally, as illustrated in FIG. 1, and explained in further detail below, a billet, such as a rectangular billet 300, is formed from molten steel. Thereafter, the billet is hot rolled into a bar having a cross-section with upper and lower width dimension and a reduced dimension approximate the center of the bar that is less than the upper and lower width dimensions. In one embodiment of the invention, the billet can be formed into a bar with cross-section in the shape of an hourglass (i.e., the hourglass lead pass bar 400 depicted in FIG. 4A) by feeding the billet through a first set of rolls (i.e., lead pass roll set) that forms the hourglass shape. As explained in further detail below the hourglass cross-section aids in the production of a substantially continuous threaded rebar 700 product with little to no longitudinal ribs 1100, as illustrated in FIGS. 7A, 7B, and 11. After the hourglass lead pass bar 400 is formed it is passed through a second set of rolls (i.e., threaded pass roll set) in order to form the substantially continuous threaded rebar 700 with little to no longitudinal ribs 1100. The billet, the lead pass bar, and the threaded rebar are typically processed consecutively at the same mill, however, it is understood that in some embodiments they may be processed at different mill sites.

In the present invention, threaded rebar 700 can be produced using conventional rebar processing equipment and without the additional steps and tooling that are used for removal of the longitudinal ribs 1100. Therefore, it is generally not necessary to use more than two rolls or more than two dies at a time to create the substantially continuous threaded rebar 700, or to use little to no additional machining, grinding, or shearing operations to remove a portion of the longitudinal ribs. The present invention results in threaded rebar 700 products that can be made utilizing standard rebar manufacturing tooling and equipment in less time and for less cost than conventional threaded rebar products made utilizing more complex manufacturing processes and equipment.

FIG. 2 illustrates one embodiment of a threaded rebar processing system 200, which can be used to manufacture threaded rebar from scrap metal in a single continuous process. As illustrated by block 102 in FIG. 1 the first step in the threaded rebar manufacturing process is to melt scrap steel into molten steel in a furnace. As illustrated in FIG. 2, in one embodiment of the invention, the furnace is an electric arc furnace ("EAF") 202 in which electrode rods melt scrap steel into molten steel. However, other types of furnaces, such as, but not limited, to blast furnaces, cyclone furnaces, etc., can also be used to melt steel. In other embodiments of the invention other types of metal besides steel, such as aluminum, brass, copper, etc. can be used to create other types of threaded bars for various applications.

As illustrated by block 104 in FIG. 1, in some embodiments of the invention, the molten steel is transferred from the EAF furnace 202 to a ladle 204. The ladle 204, as illustrated in FIG. 2, is used to refine the steel into a desired composition depending on the desired qualities of the end product by adding various amounts of elements into the molten steel. Thereafter, as illustrated by block 106 in FIG. 1, the molten steel with the desired composition in the ladle 204 is transferred into one or more tundishes. The tundishes 206, as illustrated in FIG. 2, are troughs with holes 208 in the bottom that are used to supply a smooth flow of molten steel into one or more molds 210, as described by block 108 in FIG. 1. The molds 210 used in most rebar production facilities are continuous casting water-cooled molds. The water-cooled molds produce a skin of solid metal over a liquid core. The metal exiting the water-cooled molds is generally referred to as a strand. The strand is passed through rollers and water sprayers 212, (see block 110 of FIG. 1). The rollers and water sprayers 212, as illustrated in FIG. 2, support, cool, and solidify the steel strand into a billet as the strand passes through the rollers and water sprayers 212 (see block 112 in FIG. 1). As illustrated in FIG. 2, shears 214, or in some cases torches, cut the billets into the desired lengths (see block 114 of FIG. 1).

After the billets are cut to the required lengths, they are passed through a reheating furnace 216, (see block 116 in FIG. 1). The reheating furnace 216, illustrated in FIG. 2 may be needed to ensure that the billets are at the proper temperature for hot rolling. During hot rolling, the temperature of the billet is above the recrystallization temperature of the steel, which in some embodiments of the present invention is between the range of 1650 to 2250 degrees Fahrenheit. After the billet reaches the proper temperature, the billet is fed through a series of mill stands 217, in order to reduce the cross-sectional area of the billet for additional hot rolling into a lead pass bar 400 and ultimately into a threaded rebar 700 (see block 118 in FIG. 1). In some embodiments of the invention the series of mill stands 217 comprise sets of opposed rollers that reduce the cross-sectional area of the billet from approximately thirty (30) square inches to approximately four (4) to five (5) square inches. However, in other embodiments the mill stands 217 may reduce the cross-sectional area of the billet from various larger sizes to various smaller sizes. In some embodiments of the invention there are eighteen (18) mill stands, each with a roll set, which are used to reduce the cross-sectional area of the billet. However, in other embodiments of the invention more or less stands and/or roll sets may be used to reduce the cross-sectional area of the billet into a size that can be used to create a lead pass bar 400 of selected size.

As illustrated in FIGS. 3A and 3B, the billets, in one embodiment of the application can be formed into rectangular billets 300 with a rectangular cross-sectional area. In other embodiments of the invention, the billets 300 can be formed into other cross-sectional shapes, such as an oval, circle, square, diamond, etc. In the illustrated embodiment of the invention, the billet has a width extending along a y-axis and a height extending along a x-axis, where the x and y axis intersect at a center 302 of the rectangular billet 300. The billet 300 has a length extending along a longitudinal z-axis. In other embodiments of the invention, the width may extend along the x-axis and the height may extend along the y-axis depending on how the billet is oriented.

As illustrated in block 120, after the cross-sectional area of the billet is reduced to the proper size, the hot roll lead pass 218 shapes the billet 300 into a bar with the proper cross-sectional area for producing a threaded rebar product. The type of cross-sectional area of the bar will impact the surface quality and circular cross-section of the final threaded rebar product. If a bar with the proper cross-sectional area is not used excess material can build up between the gaps 760 in the rolls and create longitudinal ribs 1100 in the threaded rebar, as illustrated in FIGS. 6C and 11. In some embodiments of the invention the billet 300 is passed through the hot rolled lead pass 218 at a rate in the range of 300 to 2600 feet per second.

In order to create threaded rebar with little to no longitudinal ribs, a bar with a reduced width along or approximate to the y-axis is helpful in reducing or eliminating the material that spreads into the gaps 760 between the rolls. The greater the width of the cross-sectional area along the y-axis of the lead pass bar the larger the longitudinal ribs along the length of the threaded rebar might be. A longitudinal rib prevents the threaded rebar from being used in conjunction with a nut or other type of mating threaded part because the longitudinal ribs prevent the threaded rebar from turning within the nut, or alternatively, could damage the threads in the nut so as to prevent the desired tightening of the nut on the threaded rebar. Where the threaded rebar includes longitudinal ribs, additional stages of manufacturing are necessary to machine, file, shear, chip, or otherwise remove the longitudinal ribs in order to allow the threaded rebar to be used as a bolt. These additional processes add increased tooling, man-hours, manufacturing time, and floor space costs that ultimately increase the overall cost of manufacturing threaded rebar.

Alternatively, not having enough cross-sectional material along the y-axis of the lead pass bar prevents the formation of a circular threaded rebar with threads that span the majority of the circumference of the threaded rebar because the material will not properly flow into the grooves and knurls in the opposing rolls. This can lead to a threaded rebar product with less tensile holding strength, weakened threaded rebar that is more apt to fail, deformed threaded rebar that cannot be secured to a nut, etc. Therefore, it is important to create a lead pass bar with a cross-sectional area that results in a threaded rebar 700 product having the proper shape for tensile strength, but with little to no longitudinal ribs 1100.

The dimensions and shape of the cross-sectional area of the lead pass bar play a role in producing threaded rebar with little to no longitudinal ribs. FIGS. 4A and 4B illustrate one embodiment of a lead pass bar that has an hourglass or peanut shaped cross-section. The lead pass bar 400 has a body extending along a longitudinal z-axis. At least a portion of the body has a cross-section defining a plane 450 in the vertical x-axis and horizontal y-axis that intersects the longitudinal z-axis as illustrated in FIG. 4B. The first part 420 of the plane 450 has a first width and the second part 430 of the plane 450 has a second width that is different than the first width of the first part 420. In other embodiments of the invention, the plane 450 has a height dimension substantially centered along the longitudinal z-axis. The first part 420 of the plane 450 is located vertically adjacent to the longitudinal z-axis and the first width is smaller than the second width of the second part 430 of the plane 450 located vertically distal from the longitudinal z-axis. In other embodiments of the invention, the first part 420 of the plane 450 is vertically adjacent to the longitudinal z-axis and the first width is smaller than the second width of the second part 430 of the plane 450, and the third width of the third part 440 of the plane 450, wherein the second part 430 of the plane 450 and third part 440 of the plane are located vertically distal from the longitudinal z-axis. In some embodiments, the first part 420 of the plane 450 is rectangular in shape and the second part 430 of the plane 450 and third part 440 of the plane 450 are at least approximately circular, wherein the second part 430 of the plane 450 is located vertically above the first part 420 of the plane 450 and the third part 440 of the plane 450 is located vertically below the first part 420 of the plane 450. In other embodiments of the invention, the x-axis may be in the horizontal position and the y-axis may be in the vertical position dependent on the position of the lead pass bar 400.

Table I illustrates ranges of dimensions for the hourglass lead pass bar 400 and the associated threaded rebar produced from the hourglass lead pass bar 400. Different combinations of dimensions in Table I may result in the same dimensions for the associated threaded rebar sizes. In one embodiment of the invention as illustrated in FIG. 4C, for the 0.680 inch rebar, the hourglass lead pass bar 400 has a second width and/or third width (e.g, upper and lower width) A of 0.5589 inches, a first width dimension B of 0.4439 inches, a bar height C of 1.0759 inches, a first part height D of 0.1789 inches, and an hourglass radius of curvature HR of 0.1975 inches. The hourglass lead pass bar 400 with these dimensions results in a threaded rebar with an approximate core diameter CD of 0.680 inches and an approximate thread diameter TD of 0.805 inches. In other embodiments of the invention other dimensions may also result in a threaded rebar with the same or similar core diameter and thread diameter.

In one embodiment of the invention, the first width dimension B is less than or equal to ninety (90) percent of the second width dimension A. For example, as illustrated in the previous example, the B dimension (0.4439) divided by the A dimension (0.5589) multiplied by one-hundred (100) equals approximately seventy-nine (79) percent, which is less than ninety (90) percent. In other embodiments of the invention other B dimensions and A dimensions may be used that result in other percentages that are less than, equal to, or greater than ninety (90) percent.

As previously discussed the shape of the lead pass bar illustrated in both FIGS. 4B and 4C may be described as having an hourglass and/or peanut shape. These shape descriptions may only generally describe the shape that the lead pass bar 400 may take in a given embodiment. For example, a traditional peanut or hourglass shape has circular opposed ends connected by a vertical shaft. In general terms, the lead pass bar 400 of various embodiments has two opposed ends with a wider dimension than a central connecting section that generally resembles a peanut or hourglass, but the lead pass bar does not have to necessarily include circular opposed ends and a flat vertical connecting section. For example, in some embodiments of the invention, the lead pass bar may have flat sections 402 in the first part 420 of the plane 450, as illustrated in FIG. 4B. However, in other embodiments of the invention the flat sections 404 may have a curved surface with an associated radius of curvature. In still other embodiments of the invention the flat sections 404 may have a v-shape or have another shape that provides a reduced cross-sectional area along or near the y-axis (i.e., mid-section of the lead pass bar) illustrated in FIGS. 4A, 4B, and 4C.

In the embodiment illustrated in FIG. 4B the hourglass lead pass bar 400 has rounded top edges 406 and bottom edges 408. In some embodiments of the invention, as illustrated in FIG. 4C, the top edge 406 and bottom edge 408 of the hourglass lead pass bar 400 are rectangular shaped. In other embodiments the top edge 406 and bottom edge 408 can have various shapes and the hourglass shape of the billet may only need to be a reduced width (i.e. the first width) that runs approximate to the y-axis of the cross-sectional area for at least a part of the length of the longitudinal z-axis of the body of the hourglass lead pass bar 400. In some embodiments the hourglass shape of the hourglass lead pass bar 400 may be hyperbolic, notched, or have some other type of geometry that has a reduced cross-sectional area in the midsection (i.e. y-plane or near the y-plane) of the bar. As explained in further detail below, the dimensions of the lead pass bar with the reduced mid-sectional width that may be necessary to produce threaded rebar 700 with little to no longitudinal ribs 1100 can be chosen based on the composition of the metal, the temperature of the hot rolling process, and the rate of hot rolling.

In order to create the hourglass lead pass bar 400, the rectangular billet 300 is fed through a lead pass roll system 500 that has opposing rolls, as illustrated in FIGS. 5A through 5C. (As an aid to understanding the figures, FIG. 5C illustrates the gap between the opposing lead pass rollers 502 and 504.) In one embodiment of the invention the lead pass roll system 500 comprises a first lead pass roll 502 and a second lead pass roll 504 (collectively the "lead pass roll set"), a transmission 506, and a bar guide 508. The first lead pass roll 502 and the second lead pass roll 504, as illustrated in FIG. 5B have grooves 510 machined or formed in the shape of half of the hourglass lead pass bar 400 (e.g., if the lead pass bar was cut along the x-axis, as illustrated in FIGS. 4A, 4B, and 8). The grooves 510 and roll surfaces 512 define the shape of the lead pass bar.

Table II and FIG. 8, as explained in further detail later, describes the ranges of dimensions of the grooves in the lead pass rolls 502, 504 of the lead pass roll system 500 for various sizes of threaded rebar (FIG. 8 illustrates one of the lead pass rolls 502). As a continuation of the example previously discussed, in order to create an hourglass lead pass bar 400 used to produced the 0.680 inch threaded rebar 700, in one embodiment, the grooves in the lead pass roll set have a groove to groove center dimension E of 0.5875 inches, a reduced height dimension F of 0.1789 inches, a height dimension H of 1.1385 inches, a groove depth dimension I of 0.2395 inches, a reduced width depth J of 0.034 inches, a narrow width radius of curvature JR of 0.0575 inches, and a groove radius of curvature IR of 0.1975 inches.

The rectangular billet 300 as illustrated in FIGS. 3A, 3B, and 5C, is fed into the hot rolled lead pass system 500 in an orientation where the x-axis of the lead pass bar lies horizontal and the y-axis of the lead pass bar is in the vertical direction with respect to the first lead pass roll 502 and second lead pass roll 504. The transmission 506 drives the first lead pass roll 502 in a counter-clockwise direction, while driving the second lead pass roll 504 in a clockwise direction. In this way, the hourglass lead pass bar 400 will exit the rolls, and thus the bar guide 508, with the x-axis in the horizontal direction and the y-axis in the vertical direction, as illustrated in FIG. 5A.

The hot rolled threaded pass 220 uses a threaded pass roll system 600, which has two opposing rolls, in order to manufacture the threaded rebar 700, as illustrated in FIGS. 6A and 6B. As illustrated in FIG. 6A, in one embodiment of the invention, the threaded pass roll system 600 comprises a first threaded pass roll 602 and a second threaded pass roll 604 (collectively the "threaded pass roll set"), a transmission 606, and bar guide 608. The first threaded pass roll 602 and the second threaded pass roll 604, as illustrated in FIG. 6B, have grooves 610 and knurls 620 machined or formed in the shape of a semi-circle. Table III and FIGS. 9A and 9B, as explained in further detail later, describe the ranges of dimensions of the grooves 610 and knurls 620 in the threaded pass rolls 602, 604 for various sizes of threaded rebar (FIG. 9A is a cross-sectional view of a groove in the threaded pass roll 602 and FIG. 9B is a cross-sectional view of a groove and knurl in the threaded pass roll). As a continuation of the example previously discussed, in order to create the 0.680 inch threaded rebar 700, in one embodiment, the threaded pass roll set has grooves 610 with a depth K of 0.3086 inches, an external width L of 0.7476 inches, an internal width M of 0.6671 inches, a depth radius of curvature MR of 0.3470 inches, and a corner radius of curvature LR of 0.040 inches. Furthermore, in this example the knurls 620 have a depth N of 0.0550 inches, a knurl radius of curvature NR of 0.4020 inches, and pitch (not illustrated) of 0.4 inches (i.e., distance between the peaks of the threads). In other embodiments of the invention, the pitch can be set at any desired pitch by changing the distance between the knurls 610 in the first threaded roll 602 and second threaded roll 604.

As illustrated by block 122 in FIG. 1, the hourglass lead pass bar 400 is fed through the hot rolled threaded pass system 600 in order to produce the threaded rebar 700 product. The hourglass lead pass bar 400 as illustrated in FIGS. 4A, 4B, and 6C, is fed into the hot rolled threaded pass system 600 in an orientation where the x-axis is in the vertical direction and the y-axis is in the horizontal direction with respect to the first threaded roll 602 and second threaded roll 604. The transmission drives the first threaded roll 602 in a counter-clockwise direction, while driving the second threaded roll 604 in a clockwise direction. In this way, the substantially continuous threaded rebar 700 will exit the rolls and the bar guide 608, with the x-axis in the vertical direction and the y-axis in the horizontal direction, as illustrated in FIG. 6A. It is important to note that, unlike other threaded rebar processes, little to no additional machining or forming steps are necessary after the threaded rebar 700 exits the threaded rebar pass 222, due to the fact that the threaded rebar 700 has little to no longitudinal ribs along at least a portion of the length of the threaded rebar 700. In some embodiments, the threaded rebar 700 that is produced after the hot rolled threaded rebar pass 222 need only be cooled, bundled with other threaded rebar, and shipped to the customer.

FIG. 7A illustrates one embodiment of the threaded rebar 700. As illustrated in FIG. 7, the top threads 702 are formed by the first threaded pass roll 602 and the bottom threads 704 are formed by the second threaded pass roll 604. It is important that the top threads 702 are substantially lined up with the bottom threads 704 in order for the threaded rebar 700 to work properly within various applications (i.e., be able to mate with a female nut, etc.). In some embodiments, the first threaded roll 602 and the second threaded roll 604 may have to be properly aligned with each other so the knurls 620 of each roll produce top threads 702 and bottom threads 704 that are substantially aligned with each other. In one embodiment, the first threaded roll 602 and the second threaded roll 604 are manually rotated and aligned in the transmission 608 of the threaded pass system 600. In other embodiments of the invention a coupling box (not illustrated) can be utilized in the transmission 606 to provide fine tuning of the alignment between the first threaded roll 602 and second threaded roll 604.

As illustrated in FIG. 7A and 7B the alignment of the top threads 702 and the bottom threads 704 produce a discontinuous threaded rebar 700 product. However, a single discontinuous thread covers substantially the entire circumference of the threaded rebar 700 thereby creating a substantially continuous thread. In some embodiments of the invention a single substantially continuous thread, made up of a top thread 702 and bottom thread 704, can span over ninety (90) percent of the circumference of the threaded rebar 700. For example, in one embodiment of the 0.680 threaded rebar (i.e. rebar with a 0.680 core diameter), the thread may cover approximately 2.01 inches of the 2.136 inch circumference of the core diameter or over ninety four (94) percent of the circumference. The circumference of the threaded rebar 700 that the substantially continuous threads cover may be changed by altering the dimensions of the knurls 620 in the grooves 610 of the first threaded roll 602 and second threaded roll 604.

Another feature of the threaded rebar 700 produced using this lead pass bar 400 is that there are little to no longitudinal ribs that run along the surface of the threaded rebar 700 in the longitudinal direction, or at least along a partial length of the threaded rebar 700. As illustrated in FIG. 11, typical threaded rebar manufactured using a rolling process has a cross section with pronounced longitudinal ribs 1100 that run the length of or at least a portion of the body of the threaded rebar. The longitudinal ribs 1100 are due to the excess material that fills the gaps 760 between the first threaded roll 602 and the second threaded roll 604, as illustrated in FIG. 6C. In a typical threaded rebar manufacturing process, these pronounced longitudinal ribs 1100 are of sufficient dimension so as to obstruct threading a nut or similar fastener onto the threaded rebar without subsequent post-forming machining, grinding, shearing, etc. of the longitudinal ribs 1100 of the threaded rebar. In the embodiments of the present invention where a little or slight longitudinal rib may exist on the threaded rebar 700, the little or slight longitudinal rib is not of sufficient dimension so as to obstruct threading a nut or similar fastener onto the threaded rebar. Therefore, subsequent post-forming machining, grinding, shearing, etc. of the longitudinal ribs of the threaded rebar is not necessary.

Even though there are little or no longitudinal ribs 1100 that run length of the threaded rebar in the present invention, because of the gap 760 between the first threaded roll 602 and the second threaded roll 604 the surface of the threaded rebar where the longitudinal ribs 1100 would have been located in typical rolling processes may have a surface finish that is more course then the surface finish of other parts of the threaded rebar.

Along with the dimensions of the hourglass lead pass bar 700, the gap distance G, as illustrated in FIG. 6C, may also play an important roll in preventing longitudinal ribs from forming along the length of the threaded rebar 700. For example, the gap distance G used to manufacture a 0.680 sized threaded rebar should be in the range of 0.005 to 0.250 in inches. In some embodiments the gap distance for the 0.680 bar is 0.031 inches. The shape of the hourglass lead pass bar 400, as well as the gap distance G, helps to prevent the metal from filling the gaps 760 between the first threaded roll 602 and the second threaded roll 604, thus preventing longitudinal ribs 1100 from forming in the present invention. If the gap 760 is too small, material may fill the gap 760 and form longitudinal ribs, or alternatively, if the gap 760 is too large the threaded rebar 700 may not form the proper cylindrically shaped core or threads.

As illustrated by FIG. 7B, the threads 702, 704 may be substantially continuous. Furthermore, the outer circumference of the threads may provide a circular or substantially circular cross-section, such that if a line was extended around the outer circumference of the threads 702, 704, the outer circumference may be circular or substantially circular, as illustrated by the thread diameter TD. Additionally, the core of the threaded rebar 700 may also be circular or substantially circular, as illustrated by the core diameter CD. As illustrated by FIG. 7B there are material voids 720 where there is a lack of metal material in the outer edges of the threaded rebar 700. The material voids 720 create the appearance that the threaded rebar 700 is not circular or substantially circular, however, as discussed the top threads 702 and bottom threads 704 have a diameter TD that is circular or substantially circular and will mate with a circular or substantially circular female threaded part.

There are three different sizes of threaded rebar 700 that are typically used in various applications; however, additional sizes may be produced in accordance with one of ordinary skill in the art in light of this specification. The three different sizes of threaded rebar 700 discussed as examples herein are set forth in Table I below and illustrated by FIG. 7B. Table I also lists the ranges of dimensions for the three sizes of hourglass lead bars 400, as illustrated in FIG. 4B, which are used for producing the three sizes of threaded rebar 700 illustrated in Table I. It is to be understood that the FIG. 4B is not to scale and the dimensions in Table I are approximate, but will allow one of ordinary skill in the art to develop a threaded rebar product with little to no longitudinal ribs having various dimensions.

The dimensions used to create the hourglass lead pass bars 400 may be adjusted based on the composition of the metal, the rate that the bar is passed through the lead pass 218 and the threaded pass 220, and the temperature to which the rectangular billet 300 and lead pass bar 400 are heated before undergoing hot rolling. For example, compositions of metal that are harder and less ductile, which are more difficult to shape, may have A and B dimensions that are in the higher end of the range, while the C dimension may be in the lower end of the range of the hourglass lead pass bar dimensions illustrated in Table I. Furthermore, hourglass lead pass bars 400 that are passed through the rolls at a rate in the higher end of the range, may have A and B dimensions that are in the higher end of the range, while the C dimension may be lower in the range in Table I. This may be due to the fact that the lead pass bars 400 spend less time being shaped by the rolls, and, thus, the material may not have as much time to be formed into the proper shape. Also, hourglass lead pass bars 400 that are heated to the lower end of the temperature range, may have A and B dimensions that are in the higher end of the range, while the C dimension may be lower in the range. This may be due to the fact that at the lower temperatures the lead pass bars 400 may be more difficult to deform than lead pass bars 400 heated to higher temperatures.

TABLE I

Hourglass Lead Bar and Threaded Rebar Dimensions

| Rebar | Hourglass Lead Bar Dimensions | | | | | Threaded Rebar Dimensions | | |
|---|---|---|---|---|---|---|---|---|
| Size | A | B | C | D | HR | CD | TD | Pitch |
| 0.562 | .408-.516 | .375-.472 | .821-1.034 | .0735-.116 | .145-.183 | .5-.629 | .597-.752 | .356-.448 |
| 0.680 | .496-.625 | .436-.549 | .9947-1.252 | .089-.1938 | .1756-.2210 | .604-.7609 | .702-.884 | .356-.448 |
| 0.1100 | .5156-.649 | .425-.579 | 1.102-1.387 | .098-.1578 | .2006-.286 | .6667-.839 | .782-.9847 | .356-.448 |

Table II illustrates three different sizes of threaded rebar 700 along with the ranges of dimensions used to create the grooves 510 in the lead pass system 500, which results in forming of the hourglass lead pass bar 400 used to manufacture the three different sizes of threaded rebar 700. FIG. 8 illustrates a roll with the dimension references for Table II. It is to be understood that FIG. 8 is not to scale and the dimensions in Table II are approximate, but will allow one of ordinary skill in the art to develop a threaded rebar 700 product with little to no longitudinal ribs having the approximate dimensions illustrated herein.

TABLE II

Hourglass Lead Pass Roll Dimensions

| Rebar | Lead Pass Roll Groove Dimensions | | | | | | |
|---|---|---|---|---|---|---|---|
| Size | E | F | H | I | J | IR | JR |
| 0.562 | .408-.516 | .0916-.1153 | .821-1.034 | .178-.2238 | .028-.049 | .147-.5588 | .3378-.4252 |
| 0.680 | .5037-.634 | .1111-.1938 | .9947-1.252 | .2128-.2679 | .034 .059 | .178-.6766 | .496-.6244 |
| 0.1100 | .7005-.8817 | .336-.4229 | 1.102-1.387 | .2148-.2705 | .044-.069 | .196-.7442 | .6015-.757 |

Table III illustrates three different sizes of threaded rebar 700 along with the ranges of dimensions used to create the grooves 610 and knurls 620 in the rolls for the threaded pass system 600 that results in the desired threaded rebar 700 product. FIGS. 9A and 9B illustrate a roll with the dimension references for Table III. It is to be understood that FIGS. 9A and 9B are not to scale and the dimensions in Table III are approximate, but will allow one of ordinary skill in the art to develop a threaded rebar 700 product with little to no longitudinal ribs having the approximate dimensions illustrated herein.

TABLE III

Threaded Rebar Pass Roll Dimensions

| Rebar | Threaded Rebar Roll Groove Dimensions | | | | | Knurl Dimensions | |
|---|---|---|---|---|---|---|---|
| Size | K | L | M | MR | LR | N | NR |
| 0.562 | .2015-.2984 | .5567-.7008 | .5045-.635 | .2358-.2968 | .0355-.0447 | .04-.0503 | .2989-.376 |
| 0.680 | .2925-.368 | .680-.8563 | .6100-.7678 | .308-.388 | .0355-.0447 | .0489-.0615 | .3573-.4498 |
| 0.1100 | .3067-.386 | .796-.998 | .6568-.8267 | .339-.427 | .0355-.0447 | .0577-.0727 | .397-.5002 |

An important part of the invention is that different types of threaded rebar can be produced by simply changing the dimensions of the grooves 510, 610 and knurls 620 in the lead pass rolls 502, 504 and threaded pass rolls 602, 604, as well as the gap 760 between the rolls. These changes can be made to create customized hourglass lead pass bars 400 that result in customized threaded rebar 700 with little to no longitudinal ribs 1100 based on the individual requirements of each customer, through an interchangeable and cost effective process utilizing standard rebar forming tooling and equipment.

In one embodiment of the invention the threaded rebar comprises various amounts of carbon, manganese, phosphorus, copper, vanadium, with the remaining composition being made up of iron and other amounts of various impurities. Table IV illustrates a range of compositions for one embodiment of the threaded rebar. However, it is to be understood that other compositions can be used to manufacture threaded rebar that comprises other amounts of the elements shown in Table IV, other compositions that do not include one or more of the elements illustrated, and/or include additional amounts of one or more elements not illustrated.

TABLE IV

| Example Composition of the Threaded Rebar | | | | | |
|---|---|---|---|---|---|
| | C | Mn | P | Cu | V |
| Percent Weight | <=0.60 | <=1.60 | <=0.06 | <=1.00 | <=0.20 |

It is to be understood that the dimension ranges and compositions described in Tables I, II, III, and IV, as well as the temperature and rate ranges described herein, are provided as examples only, and that many different types and sizes of threaded rebar can be manufactured using various metal compositions, temperatures ranges, rolling rates, and dimensions. The dimensions for the grooves 510 in the lead pass system 500, grooves 610 and knurls 620 in the threaded pass system 600, and gap distance in both systems can be varied, in order to manufacture a lead pass bar 400 that results in the desired threaded rebar 700. In light of this specification one of ordinary skill in the art can determine the necessary metal compositions, temperatures ranges, rolling rates, and/or dimensions, which may or may not be specifically described herein, that produce the desired threaded rebar product with little to no longitudinal ribs using standard rebar manufacturing tooling and equipment. Therefore, in some embodiments of the present invention the threaded rebar that may be manufactured using this process can range from size three (3) rebar up to size eighteen (18) rebar in English units, or ten (10) mm rebar to fifty-seven (57) mm rebar in metric units. In other embodiments of the invention, threaded rebar can be manufactured in sizes outside of these ranges.

FIG. 10 provides a threaded rebar process 1000 with additional steps that can be used in the threaded rebar process 100 illustrated in FIG. 1. The threaded rebar process 1000 in FIG. 10 illustrates a process in which the rolls used in the hot rolling steps are created depending on the requirements of the size of the threaded rebar 700 and the height of the threads. As illustrated by block 1002 in FIG. 10, a groove 510 is cut into a first lead pass roll 502 and a second lead pass roll 504, in order to create the hourglass profile on the hourglass lead pass bar 400. For example, in order to create the 0.680 sized threaded rebar 700 illustrated in Table I, an hourglass lead pass bar 400 with the dimensions illustrated in Table I may be used. In order to create an hourglass lead pass bar 400 with the dimensions illustrated in Table I the first lead pass roll 502 and second lead pass roll 504 may be cut to the dimensions for the 0.680 sized threaded rebar 700 illustrated in Table II.

As illustrated in block 1004 of FIG. 10, the next step in the process is to cut a groove 610 into a second roll set for the threaded rebar system 600. For example, in order to create the 0.680 sized threaded rebar 700 illustrated in Table I, a groove 610 with the dimensions for the 0.680 threaded rebar 700, as illustrated in Table III, may be created. Furthermore, as illustrated by block 1006 in FIG. 10 the associated knurls 620 for a 0.680 sized threaded rebar 700 may be created in the groove 610 in accordance with Table III.

After the first roll set (i.e., lead pass rolls) for the lead pass system 500 and the second roll set (i.e., threaded pass rolls) for the threaded rebar system 700 are created the first roll set and the second roll set are installed into the rebar processing system 200 illustrated in FIG. 2, as illustrated by block 1008. Thereafter, as illustrated by block 1010 in FIG. 10 the furnace is run and a billet is created as previously explained. Next, as illustrated by block 1012 the cross-sectional area of the billet is reduced by feeding the billet through one or more rolling mill stands. Thereafter, as illustrated by block 1014 the billet is formed into a bar having a cross-sectional area that has a reduced width dimension approximate to the center of the bar by passing the billet through a lead pass roll set, as previously explained. Finally, as illustrated by block 1016 in FIG. 10, the bar with the cross-sectional area that has a reduced width dimension approximate to the center of the bar is shaped into threaded rebar with minimal or no longitudinal ribs by passing it through the threaded pass roll set as previously explained. The process of forming a bar, passing it through one or more mill stands, passing it through a lead pass set to create an hourglass lead pass bar, and passing the lead pass bar through an additional threaded pass roll set to create threaded rebar using standard rebar processing equipment and no additional equipment or tooling is explained above with respect to FIG. 1.

The lead pass roll set and threaded pass roll set can be used to create multiple hourglass lead pass bars 400 and threaded rebar 700. Eventually, because of the continued use of the rolls, the grooves 510, 610 and the knurls 620 will become worn to the point where the threaded rebar 700 formed using the grooves 510, 610 and knurls 620 may no longer satisfy quality requirements. The lead pass roll set and threaded pass roll set have multiple grooves 510, 610 so that when one groove 510, 610 becomes worn the lead pass system 500, or threaded pass system 600 can be repositioned in a timely manner to use alternate sets of grooves 510, 610 on the same roll set, in order to continue to produce hourglass lead pass bars 400 and threaded rebar 700 with little to no lapses in the production schedule. In the case where all of the grooves 510, 610 in a roll set are worn the entire roll set may be replaced.

The threaded rebar manufactured in the present invention can be used for many applications. For example a bolt head can be attached to the threaded rebar 700 and a nut can be incorporated with the threaded rebar for use as a securing device. In some embodiments, the nut may be a machined or cast nut that works in conjunction with the threaded rebar 700 in concrete reinforcing applications, anchor tensioning applications, mine bolts, etc. In one embodiment the threaded rebar is especially useful in conjunction with a resin nut as a rock bolt in mining applications. In these applications, a pocket of resin is inserted in a core drilled in the mine ceiling or wall. Next, the threaded rebar 700 is inserted into the core and punctures the resin pocket. As the resin pocket is hardening, the resin pocket can be turned into a torquing resin nut by rotating the threaded rebar 700 in the resin pocket as it is hardening. The substantially continuous threads on the threaded rebar 700 carve grooves into the resin pocket, allowing the threaded rebar 700 to be turned at any point in the future for re-torquing or securing with the resin nut. Threaded rebar with longitudinal ribs cannot be rotated after the resin hardens because the longitudinal ribs prevent a thread from being carved into the resin nut.

The threaded rebar 700 can be used in many other applications to reduce the costs associated with using more expensive threaded rebar products. For instance, threaded rebar may be used as an alternative system for anchoring signs, cell towers, wind towers, as well as other foundation applications to concrete or other types of foundations, to name a few.

While certain exemplary embodiments have been described and shown in the accompanying drawings, it is to be understood that such embodiments are merely illustrative of, and not restrictive on, the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations, modifications, and combinations of the just described embodiments can be configured without departing from the scope and spirit of the invention. Therefore, it is to be understood that, within the scope of the appended claims, the invention may be practiced other than as specifically described herein.

What is claimed is:

1. A method of manufacturing threaded rebar comprising:

providing a lead pass bar comprising a body extending along a longitudinal axis, wherein at least one portion of the body has a cross-section defining a plane that intersects the longitudinal axis, wherein a first part of the plane has a first width, a second part of the plane has a second width, and a third part of the plane has a third width, wherein the first width is less than the second width and the third width, wherein the first part of the plane is located adjacent to the longitudinal axis, and the second part of the plane and third part of the plane are located distal from the longitudinal axis on opposite ends of the first part of the plane, wherein the lead pass bar has a X-axis through the first part of the plane, the second part of the plane and the third part of the plane, and a Y-axis through only the first part of the plane, and wherein the lead pass bar is formed in a first orientation along the longitudinal axis of the lead pass bar in one or more lead pass bar roll sets in which the X-axis is substantially perpendicular to and the Y-axis is substantially parallel to lead pass rolls of the one or more lead pass bar roll sets; and forming a threaded rebar having substantially continuous threads from the lead pass bar by hot rolling the lead pass bar in one or more threaded rebar roll sets, wherein forming the threaded rebar comprises forming the threaded rebar from the lead pass bar in a second orientation along the longitudinal axis that is different from the first orientation in which the X-axis is substantially perpendicular to and the Y-axis is substantially parallel to threaded rolls of the one or more threaded rebar roll sets, and wherein the threaded rebar is formed without having to remove longitudinal ribs along at least a portion of the body.

2. The method of claim 1, wherein a single substantially continuous thread spans at least ninety percent of a circumference of a core of the threaded rebar.

3. The method of claim 1, wherein the third width of the third part of the plane is substantially equal to the second width of the second part of the plane.

4. The method of claim 3, wherein the first part of the plane is rectangular in shape and the second part of the plane and third part of the plane are at least approximately circular, wherein the second part of the plane is located vertically above the first part of the plane and the third part of the plane is located vertically below the first part of the plane.

5. The method of claim 1, wherein the plane is peanut shaped or hourglass shaped.

6. The method of claim 1, wherein a composition of the threaded rebar comprises:

less than or equal to 0.60 wt % C;
less than or equal to 1.6 wt % Mn;
less than or equal to 0.06 wt % P;
less than or equal to 1.00 wt % Cu;
less than or equal to 0.20 wt % V; and
with the remainder being iron an unavoidable impurities.

7. The method of claim 1, wherein a thread height is at least 0.09 inches from a core of the threaded rebar.

8. The method of claim 1, wherein providing the lead pass bar comprises forming the lead pass bar from a billet.

9. The method of claim 8, wherein the lead pass bar is formed by rolling the billet though a lead pass roll set having opposed lead pass grooves that create the cross-section defining the plane that intersects the longitudinal axis comprising the first part of the plane having the first width, the second part of the plane having the second width, and the third part of the plane having the third width.

10. The method of claim 9 wherein the opposed lead pass grooves have a depth in the range of 0.178 and 0.2705 inches, a radius of curvature in the range of 0.1470 and 0.7442 inches, and a corner radius of curvature in the range of 0.3378 and 0.757 inches, all inclusive.

11. The method of claim 9 wherein the lead pass roll set has a first lead pass roll spaced apart from a second lead pass roll to create a gap between the first lead pass roll and the second lead pass roll in a range of 0.005 and 0.250 inches inclusive.

12. The method of claim 9 wherein the lead pass bar is formed through hot rolling at a temperature in the range of 1650 degrees to 2250 degrees Fahrenheit inclusive.

13. The method of claim 9 wherein the lead pass bar is formed through rolling at a rate in the range of 300 to 2600 feet per minute inclusive.

14. The method of claim 1, wherein forming the threaded rebar comprises rolling the lead pass bar though a threaded pass roll set having opposed threaded pass grooves with opposed threaded pass knurls in the opposed threaded pass grooves.

15. The method of claim 14, wherein the opposed threaded pass grooves have a depth in the range of 0.2015 and 0.386 inches, a groove radius of curvature in the range of 0.2358 and 0.4470 inches, and a corner radius of curvature in the range of 0.0355 and 0.0447 inches, all inclusive.

16. The method of claim 14, wherein the opposed threaded pass knurls have a depth in the range of 0.040 and 0.0727 inches, and a knurl radius of curvature in the range of 0.2989 and 0.5002 inches, all inclusive.

17. The method of claim 14 wherein the threaded pass roll set has a first threaded pass roll spaced apart from a second threaded pass roll to create a gap between the first threaded pass roll and the second threaded pass roll in a range of 0.005 and 0.250 inches inclusive.

18. The method of claim 1 wherein the threaded rebar is formed through the hot rolling at a temperature in the range of 1650 degrees to 2250 degrees Fahrenheit inclusive.

19. The method of claim 1 wherein the threaded rebar is formed through rolling at a rate in the range of 300 to 2600 feet per minute inclusive.

20. The method of claim 8 wherein the forming the billet comprises:

melting scrap steel into molten metal in an electric arc furnace;

transferring the molten metal from the electric arc furnace to a ladle for refining;

transferring the molten metal from the ladle to a tundish;

depositing the molten metal from the tundish into a water cooled mold to form a strand of steel;

passing the strand of steel through rollers and water sprayers to solidify the strand of steel into the billet;

cutting the billet into the desired lengths;

heating the billet in a reheating furnace for rolling; and passing the billet through one or more rolling mill stands to reduce the cross-sectional area of the billet.

21. The method of claim 1, wherein the lead pass bar comprises a height dimension in the range of 0.8210 to 1.378 inches, a first part width dimension in the range of 0.3110 and 0.579 inches, and a second part and a third part width dimension in the range of 0.4080 and 0.6490 inches, all inclusive.

22. The method of claim 1, further comprising:

cutting grooves into a lead pass roll set for forming the lead pass bar.

23. The method of claim 1, further comprising:

installing a lead pass roll set.

24. The method of claim 1, further comprising:

cutting opposed threaded pass grooves into a threaded pass roll set for forming the threaded rebar;

cutting a plurality of opposed threaded pass knurls into the opposed threaded pass grooves of the threaded pass roll set for forming the threads of the threaded rebar.

25. The method of claim 1, further comprising:

installing a threaded pass roll set for forming the threaded rebar.

26. The method of claim 1, further comprising:

synchronizing a first threaded pass roll and a second threaded pass roll in a threaded pass roll set in order to substantially align top threads and bottom threads on the threaded rebar.

27. The method of claim 26, wherein the first threaded pass roll and the second threaded pass roll in the threaded pass roll set is synchronized using a coupling box for fine adjustment.

28. The method of claim 1, wherein the threaded rebar ranges in sizes with a nominal diameter from 0.375 inches to 2.257 inches, inclusive.

29. A method of manufacturing threaded rebar comprising:

forming a lead pass bar by rolling a billet through one or more lead pass bar roll sets, the lead pass bar comprising a body extending along a longitudinal axis, wherein at least one portion of the body has a cross-section defining a plane that intersects the longitudinal axis, wherein a first part of the plane has a first width, a second part of the plane has a second width, and a third part of the plane has a third width, wherein the first width is less than the second width and the third width, wherein the first part of the plane is located adjacent to the longitudinal axis, and the second part of the plane and third part of the plane are located distal from the longitudinal axis on opposite ends of the first part of the plane, wherein the lead pass bar has a X-axis through the first part of the plane, the second part of the plane and the third part of the plane and a Y-axis through the first part of the plane;

wherein in the lead pass bar is formed with the Y-axis substantially perpendicular to the one or more lead pass bar roll sets and the X-axis substantially parallel to the one or more lead pass bar roll sets; and forming a threaded rebar having substantially continuous threads by hot-rolling the lead pass bar through one or more threaded rebar roll sets, wherein the lead pass bar is rolled through the one or more threaded rebar roll sets with the Y-axis substantially parallel to the one or more threaded rebar roll sets and the X-axis substantially perpendicular to the one or more threaded rebar roll sets, and wherein the threaded rebar is formed without having to remove longitudinal ribs along at least a portion of the body.

30. The method of claim 29, wherein a single substantially continuous thread spans at least ninety percent of a circumference of a core of the threaded rebar.

31. The method of claim 29, wherein the third width of the third part of the plane is substantially equal to the second width of the second part of the plane.

32. The method of claim 31, wherein the first part of the plane is rectangular in shape and the second part of the plane and third part of the plane are at least approximately circular, wherein the second part of the plane is located vertically above the first part of the plane and the third part of the plane is located vertically below the first part of the plane.

33. The method of claim 29, wherein the plane is peanut shaped or hourglass shaped.

34. The method of claim 29, wherein a composition of the threaded rebar comprises:

less than or equal to 0.60 wt % C;

less than or equal to 1.6 wt % Mn;

less than or equal to 0.06 wt % P;

less than or equal to 1.00 wt % Cu;

less than or equal to 0.20 wt % V; and with the remainder being iron an unavoidable impurities.

35. The method of claim 30, wherein a thread height is at least 0.09 inches from a core of the threaded rebar.

36. The method of claim 29, wherein forming the lead pass bar comprises rolling the billet though a lead pass roll set having opposed lead pass grooves that create the cross-section defining the plane that intersects the longitudinal axis comprising the first part of the plane having the first width, the second part of the plane having the second width, and the third part of the plane having the third width.

37. The method of claim 29, wherein forming the threaded rebar comprises rolling the lead pass bar though a threaded pass roll set having opposed threaded pass grooves with opposed threaded pass knurls in the opposing threaded pass grooves.

38. The method of claim 29, wherein the first threaded pass roll and the second threaded pass roll in the threaded pass roll set is synchronized using a coupling box for fine adjustment.

39. The method of claim 1, wherein the threaded rebar ranges in sizes with a nominal diameter from 0.375 inches to 2.257 inches, inclusive.

40. A hot rolled substantially continuous threaded rebar product manufactured according to the process comprising the steps of:

providing a lead pass bar comprising a body extending along a longitudinal axis, wherein at least one portion of the body has a cross-section defining a plane that intersects the longitudinal axis, wherein a first part of the plane has a first width, a second part of the plane has a second width, and a third part of the plane has a third width, wherein the first width is less than the second width and the third width, and wherein the first part of the plane is located adjacent to the longitudinal axis and the second part of the plane and third part of the plane are located distal from the longitudinal axis on opposite ends of the first part of the plane, wherein the lead pass bar has a X-axis through the first part of the plane, the second part of the plane and the third part of the plane, and a Y-axis through only the first part of the plane, and wherein the lead pass bar is formed in a first orientation along the longitudinal axis of the lead pass bar in one or more lead pass bar roll sets in which the X-axis is substantially perpendicular to and the Y-axis is substantially parallel to lead pass rolls of the one or more lead pass bar roll sets; and forming a threaded rebar having substantially continuous threads from the lead pass bar by hot rolling the lead pass bar in one or more threaded rebar roll sets, wherein forming the threaded rebar comprises forming the threaded rebar from the lead pass bar in a second orientation along the longitudinal axis that is different from the first orientation in which the X-axis is substantially perpendicular to and the Y-axis is substantially parallel to threaded rolls of the one or more threaded rebar roll sets, and wherein the threaded rebar is formed without having to remove longitudinal ribs along at least a portion of the body.

41. The hot rolled substantially continuous threaded rebar product of claim 40, wherein a single substantially continuous thread spans at least ninety percent of a circumference of a core of the threaded rebar.

42. The hot rolled substantially continuous threaded rebar product of claim 40, wherein the third width of the third part of the plane is substantially equal to the second width of the second part of the plane.

43. The hot rolled substantially continuous threaded rebar product of claim 42, wherein the first part of the plane is rectangular in shape and the second part of the plane and third part of the plane are at least approximately circular, wherein the second part of the plane is located vertically above the first part of the plane and the third part of the plane is located vertically below the first part of the plane.

44. The hot rolled substantially continuous threaded rebar product of claim 40, wherein the plane is peanut shaped or hourglass shaped.

45. The hot rolled substantially continuous threaded rebar product of claim 40, wherein a composition of the threaded rebar comprises:

less than or equal to 0.60 wt % C;

less than or equal to 1.6 wt % Mn;

less than or equal to 0.06 wt % P;

less than or equal to 1.00 wt % Cu;

less than or equal to 0.20 wt % V; and with the remainder being iron an unavoidable impurities.

46. The hot rolled substantially continuous threaded rebar product of claim 40, wherein a thread height is at least 0.09 inches from a core of the threaded rebar.

47. The hot rolled substantially continuous threaded rebar product of claim 40, wherein providing the lead pass bar comprises forming the lead pass bar from a billet.

48. The hot rolled substantially continuous threaded rebar product of claim 47, wherein the lead pass bar is formed by rolling the billet though a lead pass roll set having opposed lead pass grooves that create the cross-section defining the plane that intersects the longitudinal axis comprising the first part of the plane having the first width, the second part of the plane having the second width, and the third part of the plane having the third width.

49. The hot rolled substantially continuous threaded rebar product of claim 40, wherein forming the threaded rebar comprises rolling the lead pass bar though a threaded pass roll set having opposed threaded pass grooves with opposed threaded pass knurls in the opposed threaded pass grooves.

50. The hot rolled substantially continuous threaded rebar product of claim 40, wherein forming the billet comprises:

melting scrap steel into molten metal in an electric arc furnace;

transferring the molten metal from the electric arc furnace to a ladle for refining;

transferring the molten metal from the ladle to a tundish;

depositing the molten metal from the tundish into a water cooled mold to form a strand of steel;

passing the strand of steel through rollers and water sprayers to solidify the strand of steel into the billet;

cutting the billet into the desired lengths;

heating the billet in a reheating furnace for rolling; and passing the billet through one or more rolling mill stands to reduce the cross-sectional area of the billet.

51. The hot rolled substantially continuous threaded rebar product of claim 40, wherein the threaded rebar ranges in sizes with a nominal diameter from 0.375 inches to 2.257 inches, inclusive.

52. A system, comprising:

a lead pass roll set comprising a first lead pass roll and a second lead pass roll, wherein the first lead pass roll and the second lead pass roll have opposed lead pass grooves that form a lead pass bar having a body extending along a longitudinal axis, wherein at least one portion of the body has a cross-section defining a plane that intersects the longitudinal axis, wherein a first part of the plane has a first width, a second part of the plane has a second width, and a third part of the plane has third width, wherein the first width is less than the second width and the third width, and wherein the first part of the plane is located adjacent to the longitudinal axis and the second part of the plane and third part of the plane are located distal from the longitudinal axis on opposite ends of the first part of the plane, wherein the lead pass bar has a X-axis through the first part of the plane, the second part of the plane and the third part of the plane, and a Y-axis through only the first part of the plane, and wherein the lead pass bar is formed in a first orientation along the longitudinal axis of the lead pass bar in one or more lead pass bar roll sets in which the X-axis is substantially perpendicular to and the Y-axis is substantially parallel to lead pass rolls of the one or more lead pass bar roll sets; and a threaded pass roll set comprising a first threaded pass roll and a second threaded pass roll, wherein the first lead pass roll and the second lead pass roll have opposed threaded rebar grooves with opposed threaded rebar knurls that form a threaded rebar having substantially continuous threads from the lead pass bar by hot rolling the lead pass bar, wherein forming the threaded rebar comprises forming the threaded rebar from the lead pass bar in a second orientation along the longitudinal axis that is different from the first orientation in which the X-axis is substantially perpendicular to and the Y-axis is substantially parallel to threaded rolls of the one or more threaded rebar roll sets, and wherein the threaded rebar is formed without having to remove longitudinal ribs along at least a portion of the body.

53. The system of claim 52, wherein a single substantially continuous thread spans at least ninety percent of a circumference of a core of the threaded rebar.

54. The system of claim 52, wherein the third width of the third part of the plane is substantially equal to the second width of the second part of the plane.

55. The system of claim 54, wherein the first part of the plane is rectangular in shape and the second part of the plane and third part of the plane are at least approximately circular, wherein the second part of the plane is located vertically above the first part of the plane and the third part of the plane is located vertically below the first part of the plane.

56. The system of claim 52, wherein the plane is peanut shaped or hourglass shaped.

57. The system of claim 52, wherein a composition of the threaded rebar comprises:

less than or equal to 0.60 wt % C;

less than or equal to 1.6 wt % Mn;

less than or equal to 0.06 wt % P;

less than or equal to 1.00 wt % Cu;

less than or equal to 0.20 wt % V; and with the remainder being iron an unavoidable impurities.

58. The system of claim 52, wherein a thread height is at least 0.09 inches from a core of the threaded rebar.

59. The system of claim 52, comprising:

one or more mill stands, wherein the one or more mill stands receive a billet with a cross-sectional area and reduce the cross-sectional area of the billet, and wherein the lead pass roll set uses the billet to form the lead pass bar.

60. The system of claim 52, wherein the threaded pass roll set forms the threaded rebar with a nominal diameter from 0.375 inches to 2.257 inches, inclusive.

61. The system of claim 52, wherein the opposed lead pass grooves have a depth in the range of 0.178 and 0.2705 inches, a radius of curvature in the range of 0.1470 and 0.7442 inches, and a corner radius of curvature in the range of 0.3378 and 0.757, all inclusive.

62. The system of claim 52, wherein the first lead pass roll is spaced apart from the second lead pass roll to create a gap between the first lead pass roll and the second lead pass roll in a range of 0.005 to 0.250 inclusive.

63. The system of claim 60, wherein the threaded pass roll set comprises a first threaded pass roll and a second threaded pass roll, wherein the first threaded pass roll and the second threaded pass roll have opposed threaded pass grooves with opposed threaded pass knurls in the opposed threaded pass grooves.

64. The system of claim 63, wherein the opposed threaded pass grooves have a depth in the range of 0.2015 and 0.386 inches, a groove radius of curvature in the range of 0.2358 and 0.4470 inches, and a corner radius of curvature in the range of 0.0355 and 0.0447, all inclusive.

65. The method of claim 63, wherein the opposed threaded pass knurls have a depth in the range of 0.040 and 0.0727 inches, and a knurl radius of curvature in the range of 0.2989 and 0.5002, all inclusive.

66. The system of claim 63, wherein the first threaded pass roll is spaced apart from the second threaded pass roll to create a gap between the first threaded pass roll and the second threaded pass roll in a range of 0.005 to 0.250 inclusive.

67. The system of claim 52, further comprising:

an electric arc furnace, wherein the electric arc furnace melts scrap steel into molten metal;

a ladle, wherein the ladle is used for refining the molten metal;

a tundish, wherein the tundish holds the molten metal;

a water cooled mold, wherein the water cooled mold forms a strand of steel from the molten metal received from the tundish;

rollers and water sprayers, wherein the rollers and water sprayers solidify the strand of steel into a billet;

a cutter, wherein the cutter cuts the billet into the desired lengths; and a reheating furnace, wherein the reheating furnace heats the billet for rolling.

68. The system of claim 63, further comprising:

a coupling box, wherein the coupling box synchronizes the first threaded pass roll and the second threaded pass roll in order to substantially align opposed threaded pass knurls for forming substantially aligned top threads and bottom threads on the threaded rebar.

69. A method of manufacturing threaded rebar comprising:

providing a lead pass bar comprising a body extending along a longitudinal axis, wherein at least one portion of the body has a cross-section defining a plane that intersects the longitudinal axis, wherein a first part of the plane has a first width, a second part of the plane has a second width, and a third part of the plane has a third width, wherein the first width is less than the second width and the third width, wherein the third width of the third part of the plane is substantially equal to the second width of the second part of the plane, wherein the first part of the plane is located adjacent to the longitudinal axis and the second part of the plane and third part of the plane are located distal from the longitudinal axis on opposite ends of the first part of the plane, wherein the lead pass bar has a X-axis through the first part of the plane, the second part of the plane and the third part of the plane, and a Y-axis through only the first part of the plane, and wherein the lead pass bar is formed in a first orientation along the longitudinal axis of the lead pass bar in one or more lead pass bar roll sets in which the X-axis is substantially perpendicular to and the Y-axis is substantially parallel to lead pass rolls of the one or more lead pass bar roll sets; and forming a threaded rebar from the lead pass bar by hot rolling the lead pass bar in one or more threaded rebar roll sets, wherein forming the threaded rebar comprises forming the threaded rebar from the lead pass bar in a second orientation along the longitudinal axis that is different from the first orientation in which the X-axis is substantially perpendicular to and the Y-axis is substantially parallel to threaded rolls of the one or more threaded rebar roll sets, and wherein the threaded rebar is formed without having to remove longitudinal ribs along at least a portion of the body.

* * * * *

UNITED STATES PATENT AND TRADEMARK OFFICE

CERTIFICATE OF CORRECTION

PATENT NO. : 9,010,165 B2
APPLICATION NO. : 13/008751
DATED : April 21, 2015
INVENTOR(S) : Francis W. Griggs et al.

It is certified that error appears in the above-identified patent and that said Letters Patent is hereby corrected as shown below:

In the Claims

Column 19, lines 47-52 of Claim 1 should read as follows:

-- wherein the lead pass bar is formed in a first orientation along the longitudinal axis of the lead pass bar in one or more lead pass bar roll sets in which the X-axis is substantially parallel to and the Y-axis is substantially perpendicular to lead pass rolls of the one or more lead pass bar roll sets; and --

Column 23, lines 6-11 of Claim 40 should read as follows:

-- wherein the lead pass bar is formed in a first orientation along the longitudinal axis of the lead pass bar in one or more lead pass bar roll sets in which the X-axis is substantially parallel to and the Y-axis is substantially perpendicular to lead pass rolls of the one or more lead pass bar roll sets; and --

Column 24, lines 40-46 of Claim 52 should read as follows:

-- wherein the lead pass bar is formed in a first orientation along the longitudinal axis of the lead pass bar in one or more lead pass bar roll sets in which the X-axis is substantially parallel to and the Y-axis is substantially perpendicular to lead pass rolls of the one or more lead pass bar roll sets; and --

Column 26, lines 39-44 of Claim 69 read as follows:

-- wherein the lead pass bar is formed in a first orientation along the longitudinal axis of the lead pass bar in one or more lead pass bar roll sets in which the X-axis is substantially parallel to and the Y-axis is substantially perpendicular to lead pass rolls of the one or more lead pass bar roll sets; and --

Signed and Sealed this
Twenty-ninth Day of September, 2015

Michelle K. Lee

Michelle K. Lee
*Director of the United States Patent and Trademark Office*